US006143158A

United States Patent [19]

Nishino et al.

[11] Patent Number: 6,143,158

[45] Date of Patent: Nov. 7, 2000

[54] METHOD FOR PRODUCING AN ALUMINUM SUPPORT FOR A LITHOGRAPHIC PRINTING PLATE

[75] Inventors: Atsuo Nishino; Yoshitaka Masuda; Akio Uesugi, all of Shizuoka, Japan

[73] Assignee: Fuji Photo Film Co., Ltd., Minami-Ashigara, Japan

[21] Appl. No.: 09/063,727

[22] Filed: Apr. 24, 1998

[30] Foreign Application Priority Data

Apr. 25, 1997 [JP] Japan ..... 9-109528
Jun. 23, 1997 [JP] Japan ..... 9-166143

[51] Int. Cl.[7] ..... C25D 5/34; B23H 11/00; C25F 3/00

[52] U.S. Cl. ..... 205/219; 205/658; 205/660; 205/662; 205/672; 205/674

[58] Field of Search ..... 205/658, 659, 205/660, 661, 672, 674, 219, 220, 214, 212, 662

[56] References Cited

U.S. PATENT DOCUMENTS

| | | | |
|---|---|---|---|
| 4,536,264 | 8/1985 | Masuda et al. | 204/125.43 |
| 4,561,944 | 12/1985 | Sasaki et al. . | |
| 4,902,389 | 2/1990 | Nishino et al. . | |
| 5,141,605 | 8/1992 | Nishino et al. | 204/129.1 |

FOREIGN PATENT DOCUMENTS

| | | |
|---|---|---|
| 0595179 | 5/1994 | European Pat. Off. . |
| 52-53123205 | 3/1977 | Japan . |
| 55-137993 | 10/1980 | Japan . |
| 57-46436 | 10/1982 | Japan . |
| 62-01176594 | 12/1987 | Japan . |
| 63-176188 | 7/1988 | Japan . |
| 1-03104694 | 9/1989 | Japan . |
| 10183400 | 7/1990 | Japan . |
| 04289200 | 3/1991 | Japan . |
| 9-277735 | 10/1997 | Japan . |

*Primary Examiner*—Donald R. Valentine
*Attorney, Agent, or Firm*—Burns, Doane, Swecker & Mathis, LLP

[57] ABSTRACT

A method for producing an aluminum support for a lithographic printing plate comprising the steps of (a) electrolytic polishing an aluminum plate in an alkaline aqueous solution; and (b) electrochemically surface roughening the aluminum plate using direct or alternating current in an acidic aqueous solution in this order, and also a method for producing an aluminum support for a lithographic printing plate comprising an electrolytic polishing step of treating an aluminum plate used as an anode in an alkaline aqueous solution at a current density of 5 A/dm$^2$ to 200 A/dm$^2$ while allowing the alkaline aqueous solution to flow between the aluminum plate and an electrode at an average flow rate of 10 cm/second to 400 cm/second.

24 Claims, 8 Drawing Sheets

METHOD FOR PRODUCING AN ALUMINUM SUPPORT FOR A LITHOGRAPHIC PRINTING PLATE

FIELD OF THE INVENTION

The present invention relates to a method for producing an aluminum support for a lithographic printing plate comprising surface roughening an aluminum plate used as the support for the lithographic printing plate, and more particularly, to a method for producing an aluminum support for a lithographic printing plate suitable for surface roughening of an aluminum plate on which tatami texture-like stripes called "streaks" caused by the difference in orientation of crystal grains are liable to occur in surface treatment of the support.

BACKGROUND OF THE INVENTION

Previously, aluminum supports for lithographic printing plates have been etched in acidic or alkaline aqueous solutions for surface roughening the supports in manufacturing processes thereof. However, treatment unevenness called "streaks" has been liable to occur. This has been said to be attributed to the difference in dissolution speed of surfaces of the aluminum supports (hereinafter sometimes referred to as "aluminum plates") due to the orientation of crystals when the dissolution reaction of the surfaces proceeds.

As to electrochemically surface roughening using direct current, a method as disclosed in U.S. Pat. No. 4,902,389 which corresponds to JP-A-1-141094 (the term "JP-A" as used herein means an "unexamined published Japanese patent application") is known, and as to electrochemically surface roughening using alternating current to form honeycomb pits uniformly, a method as disclosed in U.S. Pat. No. 4,561,944 which corresponds to JP-B-5-65360 (the term "JP-B" as used herein means an "examined Japanese patent publication") is known. U.S. Pat. No. 4,561,944 discloses that the ratio Qc/Qa of the quantity of electricity Qc at the time when the aluminum plate is the cathode to the quantity of electricity Qa at the time when the aluminum is the anode is suitably from 1 to 2.5, and if it is more than 2.5, uniform grain is not formed and energy efficiency is reduced. Further, as to the electrochemically surface roughening using alternating current, JP-A-55-137993 discloses that the ratio Qc/Qa is suitably from 0.3 to 0.95.

JP-A-63-176188 discloses that it is effective to conduct electrolytic polishing treatment after the electrochemically surface roughening treatment.

Further, JP-A-6-135175 discloses that it is effective to conduct chemically etching before and after the electrochemically surface roughening treatment.

As described above, surface roughening of an aluminum plate is carried out by mechanically surface roughening, electrochemically surface roughening, electrolytic polishing, and chemical etching in combination appropriately.

However, when there is a difference in orientation of crystal grains in the aluminum plate to be processed, tatami texture-like stripes called "streaks" as described above tend to occur upon chemical etching. Accordingly, it is necessary to control the heat treatment conditions of the aluminum plate rolling process more severely and as a result, the conventional methods were industrially disadvantageous.

On the other hand, JP-B-57-46436 discloses a process comprising conducting alkaline electrolytic polishing treatment and an aluminum plate that has been mechanically surface roughened, and then, anodizing the plate.

In this process, however, it is neither described nor studied how the alkaline electrolytic polishing treatment acts on the occurrence of the treatment unevenness caused by the orientation of crystal grains.

On the other hand, there is a demand for reduced consumption of the alkaline aqueous solution. For this purpose, it is necessary to establish a high concentration of aluminum in the alkaline aqueous solution and to decrease the amount of the aqueous solution discharged to the outside of a system. However, when the concentration of aluminum in the alkaline aqueous solution is established high, the problems of elevated electrolytic voltage, a tendency to develop the treatment uneveness and formation of oxide films which can not be easily removed have been encountered.

SUMMARY OF THE INVENTION

The present invention provides a method for producing an aluminum support for a lithographic printing plate, which can efficiently surface roughen an aluminum plate at depressed treatment cost without a deterioration in corrosion resistance, said aluminum plate suffering from the treatment unevenness caused by the difference in orientation of crystal grains in conventional methods.

The present invention also provides a method for producing an aluminum support for a lithographic printing plate, which can surface roughen an aluminum plate at low cost with depressed consumption of an alkaline aqueous solution, said aluminum plate suffereing from the treatment unevenness caused by the difference in orientation of crystal grains in conventional methods.

Then, as a result of intensive studies, the present inventors have discovered that electrolytic polishing treatment using an aluminum plate as an anode in an alkaline aqueous solution brings about no treatment unevenness caused by the difference in orientation of crystal grains in the aluminum plate, thus comprising a method for producing an aluminum support for a lithographic printing plate according to the present invention.

The present inventors have also discovered that the consumption of an alkaline aqueous solution can be depressed and the treatment unevenness caused by the difference in orientation of crystal grains is not developed on an aluminum plate after treatment by treating the aluminum plate while allowing the alkaline aqueous solution to flow between the aluminum plate and an electrode at an average flow rate of 10 cm/second or more, when electrolytic polishing treatment is conducted in the alkaline aqueous solution using the aluminum plate as an anode, thus completing a method for producing an aluminum support for a lithographic printing plate according to the present invention.

That is to say, the present invention provides:

(1) a method for producing an aluminum support for a lithographic printing plate comprising the steps of:

(a) electrolytic polishing an aluminum plate in an alkaline aqueous solution; and (b) electrochemically surface roughening the aluminum plate using direct or alternating current in an acidic aqueous solution in this order;

(2) a method for producing an aluminum support for a lithographic printing plate comprising the steps of:

(a) electrochemically surface roughening an aluminum plate using direct or alternating current in an acidic aqueous solution; and (b) electrolytic polishing the aluminum plate in an alkaline aqueous solution in this order;

(3) a method for producing an aluminum support for a lithographic printing plate comprising the steps of:

(a) electrolytic polishing an aluminum plate in an alkaline aqueous solution;

(b) electrochemically surface roughening the aluminum plate using direct or alternating current in an acidic aqueous solution; and (c) electrolytic polishing an aluminum plate in an alkaline aqueous solution in this order;

(4) a method for producing an aluminum support for a lithographic printing plate comprising the steps of:

(a) chemically etching an aluminum plate in an acidic or alkaline aqueous solution;

(b) electrochemically surface roughening the aluminum plate using direct or alternating current in an acidic aqueous solution; and (c) electrolytic polishing the aluminum plate in an alkaline aqueous solution in this order; and (5) a method for producing an aluminum support for a lithographic printing plate comprising the steps of:

(a) electrolytic polishing an aluminum plate in an alkaline aqueous solution;

(b) electrochemically surface roughening the aluminum plate using direct or alternating current in an acidic aqueous solution; and (c) chemically etching an aluminum plate in an acidic or alkaline aqueous solution in this order.

The present invention also provides:

(6) a method for producing an aluminum support for a lithographic printing plate comprising an electrolytic polishing step of treating an aluminum plate used as an anode in an alkaline aqueous solution at a current density of 5 $A/dm^2$ to 400 $A/dm^2$ while allowing the alkaline aqueous solution to flow between the aluminum plate and an electrode at an average flow rate of 10 cm/second to 400 cm/second;

(7) the method described in the above (6), wherein the alkaline aqueous solution is an aqueous solution having an alkaline substance concentration of 2% to 30% by weight and an aluminum concentration of 0.5% to 10% by weight; and (8) the method described in the above (5) or (6), wherein the alkaline aqueous solution is an alkaline aqueous solution having a temperature of 20° C. to 80° C.

The present invention further provides:

(9) the method described in the above (1) or (2), wherein the aluminum plate is chemically etched in an alkaline or acidic aqueous solution, or electrolytically etched using the aluminum plate as a cathode in an alkaline or acidic aqueous solution, before and/or after the electrolytic polishing treatment in the alkaline aqueous solution;

(10) the method described in the above (1) or (2), wherein the aluminum plate is desmutted after the chemical etching treatment in the alkaline aqueous solution or the electrolytic etching treatment using the aluminum plate as the cathode in the alkaline aqueous solution;

(11) the method described in the above (1) or (2), wherein the alkaline aqueous solution used in the electrolytic polishing treatment is an aqueous solution mainly containing sodium hydroxide;

(12) a method comprising mechanically surface roughening an aluminum plate, and then, conducting the treatment according to any one of the above-mentioned methods;

(13) any one of the above-mentioned methods, wherein the aluminum plate is further subsequently anodized; and

(14) the method described in the above (13), wherein the aluminum plate is anodized, and then, hydrophilized.

Further, in the above-mentioned method according to the present invention, the amount of aluminum dissolved in the electrolytic polishing treatment step can be reduced by conducting the chemical etching treatment in the alkaline or acidic aqueous solution or the electrolytic etching treatment using the aluminum plate as the cathode in the alkaline or acidic aqueous solution before the electrolytic polishing treatment in the alkaline aqueous solution. Further, rolling oil, abrasives, oxide films and smut components are removed, so that the electrolytic polishing treatment is uniformly conducted.

Furthermore, in the above-mentioned method according to the present invention, by-products such as oxide films and smuts produced by the electrolytic polishing treatment can be removed by conducting the chemical etching treatment in the alkaline or acidic aqueous solution or the electrolytic etching treatment using the aluminum plate as the cathode in the alkaline or acidic aqueous solution after the electrolytic polishing treatment in the alkaline aqueous solution.

Accordingly, the by-products such as oxide films and smuts produced by the electrolytic polishing treatment can be removed to uniformly conduct electrochemical surface roughening in the subsequent step, and the aluminum plate after the anodizing treatment can be made into a more excellent aluminum support for a lithographic printing plate.

It is further possible to establish the concentration and the temperature of the alkaline aqueous solution used in the electrolytic polishing treatment lower than those of a chemical etching solution, which provides the advantage that adjustment and control are easy.

BRIEF DESCRIPTION OF THE DRAWINGS

In the accompanying drawings.

DETAILED DESCRIPTION OF THE INVENTION

Figure 1:
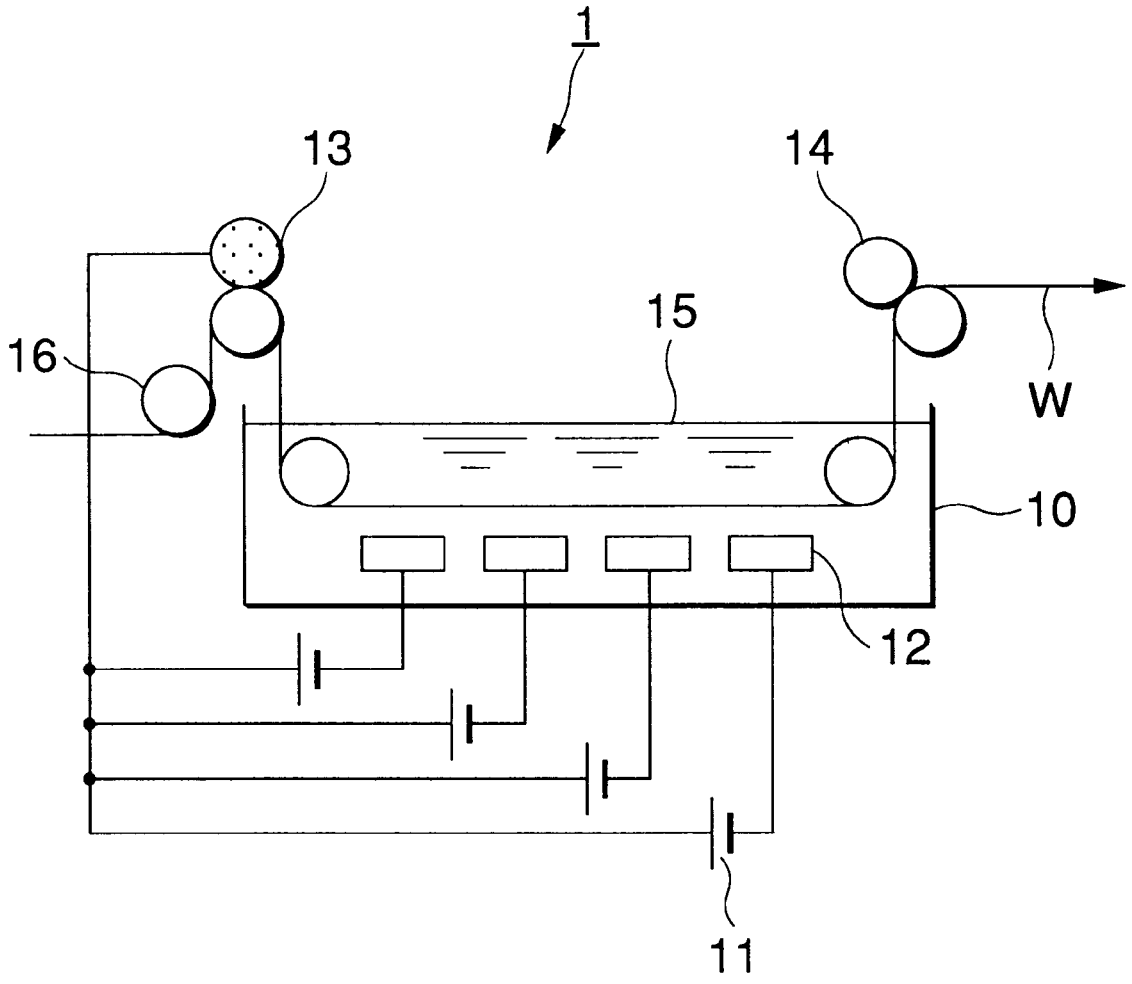
FIG. 1 is a schematic view showing an electrolytic polishing device for performing a method for producing an aluminum support for a lithographic printing plate according to the present invention.

Embodiments of the invention are described in detail below.

(Embodiment 1)

An aluminum plate is treated in order of (1) to (4) described below:

(1) Chemical Etching Treatment of Aluminum Plate in Acidic or Alkaline Aqueous Solution For removing natural oxide films, smuts and rolling oil on a surface of the plate to homogenize the state of the surface, the aluminum plate is dissolved in an amount of 0.1 $g/m^2$ to 20 $g/m^2$. When mechanical surface roughening is employed in the preceding treatment, this treatment also serves as a function of smoothing sharp unevenness formed by the mechanical surface roughening.

(2) Electrochemical Surface Roughening Treatment Using Direct or Alternating Current in Acidic Aqueous Solution This treatment is conducted for forming pits having an average diameter of 0.1 $\mu$m to 3 $\mu$m on the surface of the aluminum plate. However, when the quantity of electricity is relatively increased, the surface having large undulations is formed. The smut components are produced in an amount of 0.3 $g/m^2$ to 2 $g/m^2$ by the electrochemical surface roughening treatment.

(3) Electrolytic polishing Treatment of Aluminum Plate in Alkaline Aqueous Solution This treatment is a process of etching the aluminum plate so as not to develop streaks caused by the difference in orientation of crystal grains in the aluminum plate, and conducted for smoothing edge portions of the honeycomb pits. formed by the electrochemical surface roughening treatment. The amount of the aluminum plate dissolved in preferably from 0.01 $g/m^2$ to 3 $g/m^2$. In the electrolyte polishing treatment, 0.01 $g/m^2$ to 5 $g/m^2$, preferably 0.1 $g/m^2$ to 3 $g/m^1$ of oxide films or smut components are formed on the surface of the aluminum plate.

(4) Anodizing Treatment

The anodising treatment is performed for enhancing the corrosion resistance of the surface of the aluminum plate.

(Embodiment 2)

An aluminum plate is treated in order of (1) to (4) described below:

(1) Electrolytic polishing Treatment of Aluminum Plate in Alkaline Aqueous Solution This treatment is a process of etching the aluminum plate so as not to develop streaks caused by the difference in orientation of crystal grains in the aluminum plate. It is preferred that the aluminum plate is dissolved in an amount of 0.01 $g/m^2$ to 20 $g/m^2$, preferably 0.1 $g/m^2$ to 20 $g/m^2$. In the electrolytic polishing treatment, 0.01 $g/m^2$ to 8 $g/m^2$ of oxide films or smut components are formed on the surface of the aluminum plate. Further, when mechanical surface roughening is employed in the preceding treatment, this treatment also serves as a function of smoothing sharp unevenness formed by the mechanical surface roughening.

(2) Electrochemical Surface Roughening Treatment Using Direct or Alternating Current in Acidic Aqueous Solution This treatment is similar to that of embodiment 1.

(3) Chemical Etching Treatment of Aluminum Plate in Acidic or Alkaline Aqueous Solution This treatment is conducted for smoothing edge portions of the honeycomb pits formed by the electrochemical surface roughening treatment, and for removing smut components mainly composed of aluminum hydroxide components or oxide films formed by the electrochemical surface roughening treatment. The amount of the aluminum plate dissolved is preferably from 0.1 $g/m^2$ to 5 $g/m^2$, more preferably from 0.1 $g/m^2$ to 3 $g/m^2$, besides the oxide films or the smut components formed by the preceding electrochemical surface treatment.

(4) Anodizing Treatment

This treatment is similar to that of embodiment 1.

(Embodiment 3)

An aluminum plate is treated in order of (1) to (4) described below:

(1) Electrolytic polishing Treatment of Aluminum Plate in Alkaline Aqueous Solution This treatment is similar to that of embodiment 2.

(2) Electrochemical Surface Roughening Treatment Using Direct or Alternating Current in Acidic Aqueous Solution This treatment is similar to that of embodiment 1.

(3) Electrolytic polishing Treatment of Aluminum Plate in Acidic Aqueous Solution This treatment is similar to that of embodiment 1.

(4) Anodizing Treatment

This treatment is similar to that of embodiment 1.

(Embodiment 4)

An aluminum plate is treated in order of (1) to (3) described below:

(1) Mechanical Surface Roughening (2) Electrolyte polishing Treatment of Aluminum Plate in Alkaline Aqueous Solution This treatment is similar to that of embodiment 2.

(3) Anodizing Treatment

This treatment is similar to that of embodiment 1.

(Embodiment 5)

When chemical etching treatment in an alkaline or acidic aqueous solution or electrolytic etching treatment using the aluminum plate as a cathode in an alkaline or acidic aqueous solution is carried out before and/or after the electrolytic polishing treatment in the alkaline aqueous solution, a more excellent aluminum support for a lithographic printing plate can be obtained.

At this time, the amount of the aluminum plate dissolved is preferably from 0.01 $g/m^2$ to 5 $g/m^2$, more preferably from 0.01 $g/m^2$ to 3 $g/m^2$, and particularly preferably from 0.01 $g/m^2$ to 3 $g/m^2$.

The amount of aluminum dissolved in the electrolytic polishing treatment step can be reduced by conducting the chemical etching treatment in the alkaline or acidic aqueous solution or the electrolytic etching treatment using the aluminum plate as the cathode in the alkaline or acidic aqueous solution before the electrolytic polishing treatment in the alkaline aqueous solution. Further, rolling oil, abrasives, oxide films and smut components are removed, so that the electrolytic polishing treatment is uniformly conducted.

The chemical etching treatment in the alkaline or acidic aqueous solution or the electrolytic etching treatment using the aluminum plate as the cathode in the alkaline or acidic aqueous solution after the electrolytic polishing treatment in the alkaline aqueous solution is performed for removing by-products such as oxide films and smuts produced by the electrolytic polishing treatment.

Such treatment can remove the by-products such as oxide films and smuts produced by the electrolytic polishing treatment can be removed to uniformly conduct electrochemical surface roughening in the subsequent step, and the aluminum plate after the anodizing treatment can be made into a more excellent aluminum support for a lithographic printing plate.

(Embodiment 6)

When the chemical etching is conducted using the alkaline aqueous solution or the electrolytic etching treatment is conducted using the aluminum plate as the cathode in the alkaline aqueous solution according to any one of embodiments 1 to 5 described above, smuts are generally formed on an aluminum surface. It is therefore preferred that desmutting treatment is performed by use of phosphoric acid, nitric acid, sulfuric acid, chromic acid, hydrochloric acid, or a mixed acid containing two or more of them.

(Embodiment 7)

The treatment described in any one of embodiments 1 to 3 and embodiments 5 and 6 subsequent to the mechanical surface roughening treatment can reduce electric power consumed in the electrochemical surface roughening and makes more inconspicuous the treatment unevenness caused by the difference in orientation of aluminum crystal grains.

(Embodiment 8)

When the aluminum plate is electropolished using the aluminum plate as the anode in the alkaline aqueous solution, the electrolytic voltage between the aluminum plate and the cathode opposite thereto is preferably from 1 V to 20 V. Exceeding 20 V results in formation of strong, thick oxide films, which causes difficulty in performing uniform treatment in the subsequent step.

The aluminum plates used in the producing methods according to the present invention are selected from pure aluminum plates, alloy plates mainly composed of aluminum and containing slight amounts of different elements and plastic films laminated or deposited with aluminum.

The different elements contained in the above-mentioned aluminum alloys include silicon, iron, nickel, manganese, copper, magnesium, chromium, zinc, bismuth, titanium and vanadium. Usually, previously known materials described in *Aluminum Handbook*, the fourth edition, (Keikinzoku Kyokai, 1990) such as JIS A 1050, JIS A 3103, JIS A 3005, JIS A 1100 and JIS A 3004 materials, or alloys in which 5% by weight or less of magnesium is added thereto for the purpose of increasing tensile strength can be used.

The producing methods according to the present invention are particularly suitable for surface roughening of aluminum plates produced by DC casting processes from which process annealing and soaking are excluded, or aluminum plates produced by continuous casting process from which process annealing is excluded, in which the trouble caused by the orientation of crystal grains occurs.

The above-mentioned aluminum plates may be aluminum plates produced by continuous casting rolling processes, as well as ones produced by conventional DC casting processes. As the continuous casting rolling processes, twin roll processes, belt caster processes and block caster processes can be used. The thickness of the aluminum plates used in the present invention is from about 0.1 mm to about 0.6 mm. Aluminum plates produced by DC casting processes from which process annealing and soaking are excluded may be used.

In the producing methods according to the present invention, known devices used in continuous surface treatment of metal webs are all applicable as devices used in the electrochemical surface roughening using direct or alternating current or the electrolytic polishing.

In the producing methods according to the present invention, surface treatment in combination with at least one of mechanical surface roughening, electrochemical surface roughening, chemical etching, anodizing and hydrophilizing can provide surfaces suitable for the aluminum supports for lithographic printing plates.

Then, photosensitive layers, or photosensitive layers and intermediate layers are coated thereon and dried by conventional methods, thereby obtaining presensitized plates excellent in printing performance. In order to improve the adhesion of the photosensitive layer to a lithographic film in vacuum printing, a matte layer may be formed on the photosensitive layer. In order to prevent the elution of aluminum in development, a backcoat layer may be provided on the back side thereof. Further, the present invention is applicable to the production of presensitized plates both sides as well as one side of which are treated.

The present invention can be applied to not only surface roughening of the aluminum supports for lithographic printing plates, but also surface roughening of all aluminum plates.

The respective treatments employed in the producing methods according to the present invention are described below in more detail.

[Electrolytic polishing Treatment in Alkaline Aqueous Solutions]

The electrolytic polishing treatment in alkaline aqueous solutions as used in the producing methods according to the present invention means electrolytic treatment using aqueous solutions of alkaline substances such as sodium hydroxide, potassium hydroxide, sodium carbonate and sodium phosphate alone or mixtures thereof, mixtures of the alkaline substances and zinc hydroxide and aluminum hydroxide, or mixtures of these alkaline substances and salts such as sodium chloride and potassium chloride, and using aluminum plates as anodes at such an electrolyte composition, temperature and concentration that deoxidizing materials are electrically given.

Further, in order to stably produce uniform oxide films, hydrogen peroxide or phosphates may be added at a concentration of 1% by weight or less.

Although known aqueous solutions used in electrolytic polishing can be used, aqueous solutions mainly containing sodium hydroxide are preferred. An aqueous solution containing preferably 1% to 30% by weight, more preferably 2% to 30% by weight of sodium hydroxide is used, and particularly an aqueous solution containing 3% to 20% by weight of sodium hydroxide is preferred. Less than 1% by weight results in a tendency to form anodic oxide films, which causes a tendency to raise electrolytic voltage. Exceeding to 30% by weight results in strong chemical solubility to make streaks visible.

The solution temperature is preferably from 10° C. to 90° C., more preferably from 20° C. to 80° C., and particularly preferably from 30° C. to 50° C. Less than 10° C. results in a tendency to form anodic oxide films, whereas exceeding 90° C. results in strong chemical solubility to make streaks visible.

The current density is generally from 1 $A/dm^2$ to 200 $A/dm^2$, preferably from 5 $A/dm^2$ to 200 $A/dm^2$, more preferably from 10 $A/dm^2$ to 80 $A/dm^2$, and most preferably from 10 $A/dm^2$ to 60 $A/dm^2$. The electrolytic time can be selected from the range of 1 second to 600 seconds, preferably 1 second to 180 seconds.

Further, the alkaline aqueous solution contains preferably 0.5% by weight to 10% by weight of aluminum, and particularly preferably 1% by weight to 8% by weight of aluminum. If the aluminum concentration is less than 0.5% by weight or less, the amount of waste liquid is increased, and it becomes difficult to recover alkalis by crystallization and to discharge aluminum to the outside of a system. If the aluminum concentration exceeds 10% by weight, strong oxide films becomes liable to be formed and the electric conductivity of the alkaline aqueous solution is reduced to raise electrolytic voltage.

Of course, alloy components contained in an aluminum alloy may be contained in an amount of 0% to 10% by weight.

When continuous direct current is used, the electrolytic voltage between the aluminum plate and the cathode is from 1 V to 100 V. However, it is preferred that the electrolytic conditions are adjusted to give an electrolytic voltage of 1 V to 30 V, preferably 2 V to 15 V.

In the producing methods according to the present invention, aluminum plates W can be continuously treated by use of electrolytic polishing devices equipped with conveying systems as shown in FIGS. 1 to 5.

Referring to FIGS. 1 to 5, the reference numerals 1, 2, 3, 4 and 5 indicate the electrolytic polishing devices, the reference numerals 10, 20, 30, and 40 indicate electrolytic polishing tanks, the reference numerals 11, 21, 31, 41 and 51 indicate power supplies, the reference numerals 12, 22, 32 and 42 indicate cathodes, the reference numeral 13 indicates a feeder roll, the reference numeral 14 indicates nip rolls, the reference numerals 15, 25, 35, and 45 indicate treating liquids, the reference numeral 16 indicates a path roll, the reference numerals 23, 33 and 43 indicate anodes, the reference character W indicates aluminum plates, the reference numerals 29, 29A and 29B indicate feeder tanks. Referring to FIG. 6, the reference numeral 52 indicates a radial drum roll, the reference numerals 53*a* and 53*b* indicate main electrodes, the reference numeral 54 indicates an electrolyte supplying inlet, the reference numeral 57 indicates an electrolyte passage, the reference numeral 58 indicates an auxiliary electrode, and the reference numeral 80 indicates an auxiliary electrode tank.

Although it is possible to use direct current, pulse direct current and alternating current as electric current, continuous direct current is preferred. As the electrolytic polishing tanks, known tanks used for electrolytic treatment such as flat type tanks and radial type tanks can be used.

The average flow rate between the aluminum plate and the electrode, which may be either a parallel flow or a counter flow to the aluminum plate, is preferably from 1 cm/second to 400 cm/second. The distance between the aluminum plate and the electrode is preferably from 0.3 cm to 30 cm. The feeding method may be either a direct feeding system using a feeder roll (see FIG. 1) or a liquid feeding system using no feeder roll (see an indirect feeding system shown in FIGS. 2 to 5).

As to the materials and structure of the electrodes used, known ones used in electrolytic treatment can be used. When the liquid feeding system is used, it is preferred that the electrolytic cell in which the anode is arranged is separated from the electrolytic cell in which the cathode is arranged. The aluminum plate passing between the electrolytic cell in which the anode is arranged and the electrolytic cell in which the cathode is arranged is possibly broken by melting because of its heat generation caused by the flow of current. For cooling, therefore, it is preferred that an electrolyte is sprayed from a spray nozzle.

When the liquid feeding system is used, the electrolytic cell in which the anode is arranged function as an electrolytic etching tank in which the aluminum plate is used as a cathode. The electrolyte of the electrolytic cell in which the anode is arranged may be either an acid or an alkali.

Cathode materials are preferably carbon, silver, nickel, pure iron, stainless steel, titanium, tantalum, niobium, zirconium, hafnium and platinum. Anode materials are preferably ferrite, platinum and iridium oxide.

As the electrolytic treating devices, known devices can be used. The aluminum plate may be treated on a surface side or a back side, or on one side or both sides.

When the indirect feeding system is used, for preventing the consumption of the anode, it is preferred that the electrolytic cell in which the anode is arranged is separated from the electrolytic cell in which electrolytic polishing is carried out, and that the solution composition and temperature of the electrolytic cell in which the anode is arranged are established lower than those of electrolytic polishing.

Figure 2:
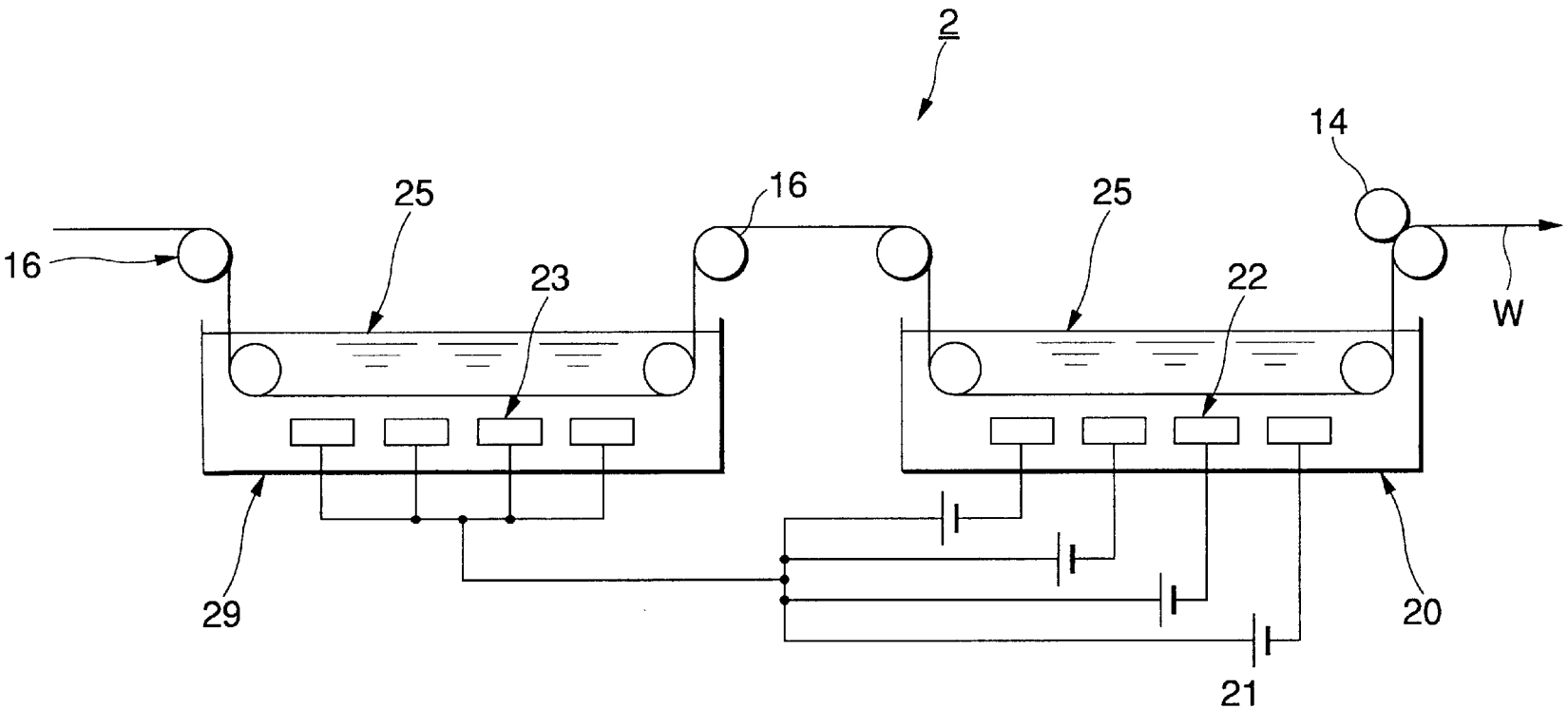
FIG. 2 is a view showing one embodiment of a device used in electrolytic polishing in a method for producing an aluminum support for a lithographic printing plate according to the present invention.
Figure 3:
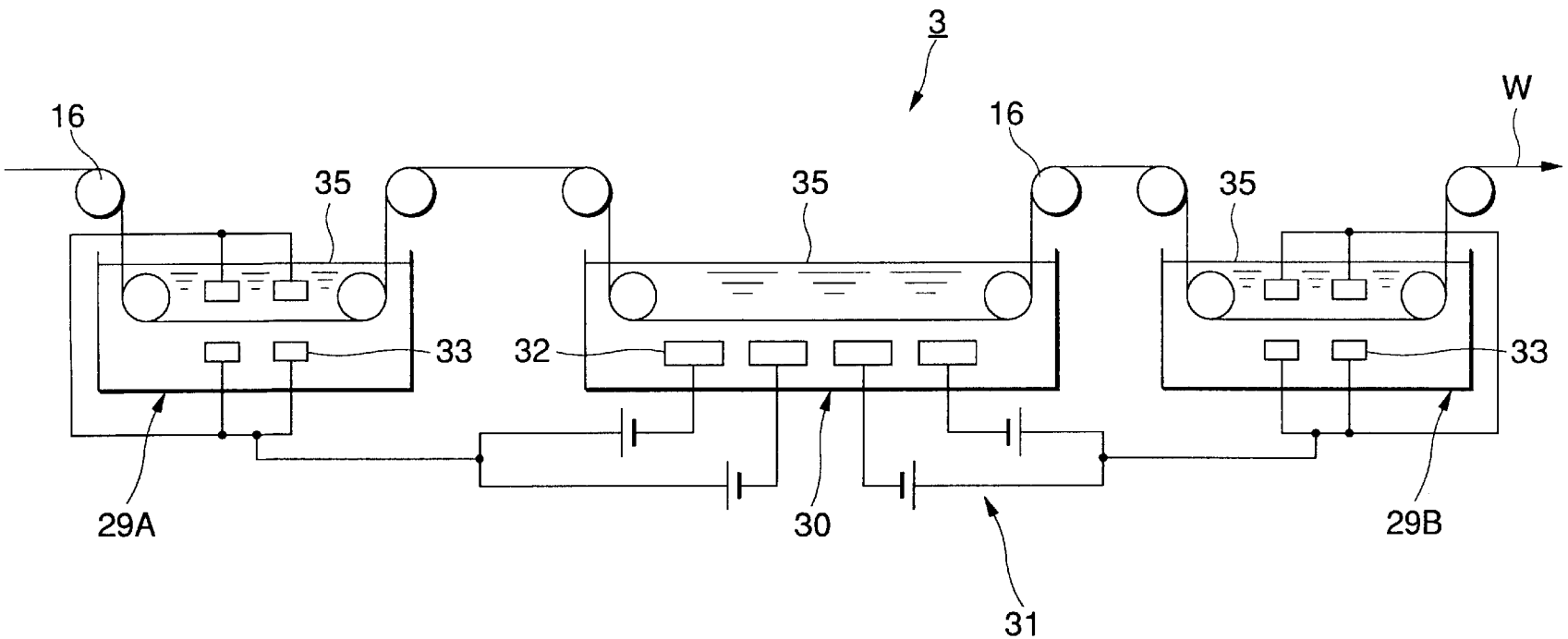
FIG. 3 is a view showing another embodiment of a device used in electrolytic polishing in a method for producing an aluminum support for a lithographic printing plate according to the present invention.

When the solution temperature, the composition and the average flow rate are constant, the appearance of streaks varies depending on the current density. Accordingly, it is more preferred that the power supply is divided to control the current density so as to give a constant value, as shown in FIGS. 2 and 3.

Further, in the producing method according to the present invention, the aluminum plate is electropolished while passing an electric current through the aluminum plate and allowing the alkaline aqueous solution to flow through a space between the aluminum plate and the electrode at a specified flow rate.

Figure 7:
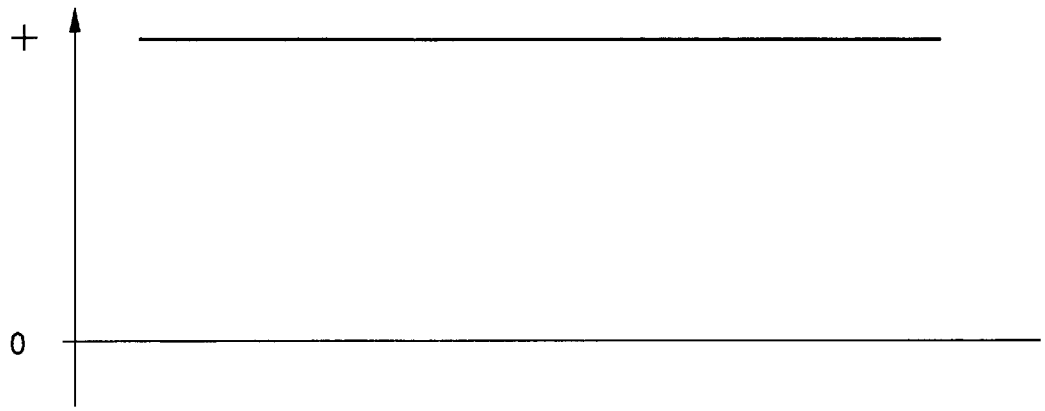
FIG. 7 is a waveform diagram showing one example of a direct current waveform used in electrolytic polishing treatment.

An electric current, direct current, pulse direct current and alternating current can be used. Pulse or continuous direct current is preferred. From the standpoint of installation cost, it is preferable to use continuous current obtained by converting commercial alternating current to direct current with a rectification circuit using a rectifying device, and then, smoothing it with a smoothing circuit. As the rectification circuit and smoothing circuit, general ones can be used. Further, the ripple percentage of the continuous current is preferably from 0% to 80%. An example of the continuous current is shown in FIG. 7.

Figure 8:
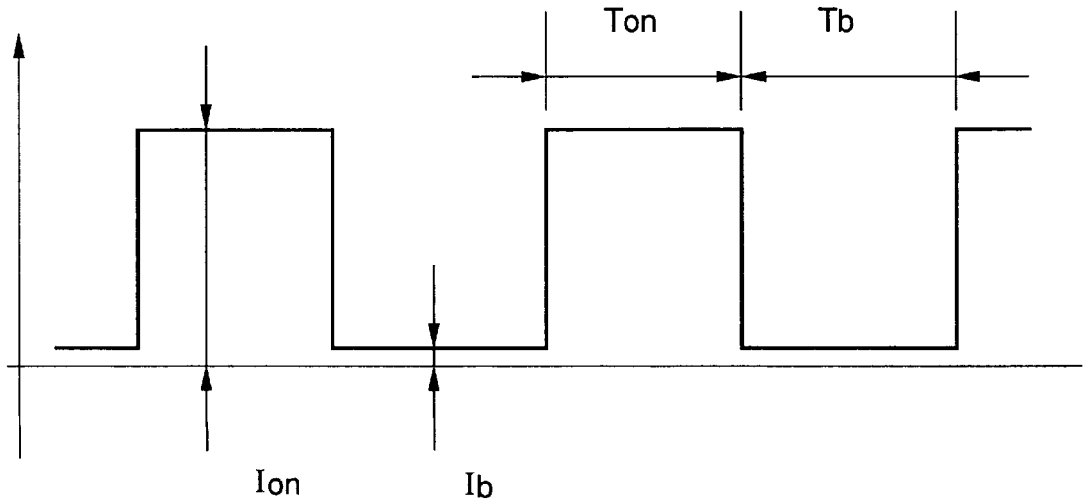
FIG. 8 is a waveform diagram showing another example of a direct current waveform used in electrolytic polishing treatment.

With respect to the pulse direct current, it is preferred that the duty ratio of the energized time Ton to the quiescent time Tb is formed 100:1 to 1:100, and that the energized time Ton per pulse is from 1 millisecond to 200 seconds, as shown in FIG. 8. The rising time and fall time of a waveform are preferably 0 millisecond to 10 milliseconds. For the pulse direct current, current Ib flowing for the quiescent time Tb is preferably 0. However, it is difficult to make it 0, so that the current density of Ib is preferably from 0 $A/dm^2$ to 10 $A/dm^2$.

The use of pulse current alternately repeats formation and dissolution of oxide films. Therefore, better polished surfaces are obtained by establishment of Ton and Tb, and the ratio thereof.

As the electrolytic polishing devices, known tanks used for electrolytic treatment such as flat type tanks and radial type tanks can be used. A plurality of electrolytic polishing devices may be arranged so as to treat the aluminum plate by passing it successively through them.

However, it is necessary to allow the alkaline aqueous solution to flow through a space between the aluminum plate and the electrode. The flow rate at that time is preferably from 10 cm/second to 400 cm/seconds, and particularly preferably from 15 cm/second to 200 cm/second in the average flow rate. Further, the flow direction of the alkaline aqueous solution may be either a parallel flow or a counter flow to the aluminum plate. If the average flow rate is less than 10 cm/second, streaks become visible when the concentration of aluminum in the alkaline aqueous solution is established high. Exceeding 400 cm/second uneconomically results in high power cost of a supplying pump.

Further, the distance between the aluminum plates and the electrode is preferably from 0.3 cm to 30 cm.

The feeding method to the aluminum plate may be either a direct feeding system using a conductor roll or a liquid feeding system using no conductor roll (indirect feeding system).

As to the materials and structure of the electrodes used, known ones used in electrolytic treatment can be used.

When the liquid feeding system is used, it is preferred that the electrolytic cell in which the anode is arranged (hereinafter referred to as a feeder tank) is separated from the electrolytic cell in which the cathode is arranged to conduct electrolytic polishing (hereinafter referred to as an electrolytic polishing tank). When the aluminum plate passes between the feeder tank and the electrolytic polishing tank, the aluminum plate is possibly broken by melting because of its heat generation caused by the flow of current. For cooling, therefore, it is preferred that the same electrolyte as that in both the electrolytic cells is supplied to the aluminum plate.

Further, when the liquid feeding system is used, for depressing consumption of the anode, it is preferable to establish the solution composition and temperature of the feeder tank lower than those of the electrolytic polishing tank.

Cathode materials are preferably carbon, silver, nickel, pure iron, stainless steel, titanium, tantalum, niobium, zirconium and hafnium.

Anode materials are preferably ferrite, platinum and platinum group metals. When platinum and platinum group metals are used, valve metals such as titanium, tantalum, niobium and zirconium clad or plated with platinum are preferably used.

It is further preferred that a plurality of anodes or cathodes are arranged and divided power supplies connected thereto are used to control the current distribution in the electrolytic cell.

The aluminum plate may be treated on a surface side or a back side, or on one side or both sides.

On the surface of the electropolished aluminum plate, byproducts such as oxide films and smuts are produced in an amount of 0.01 $g/m^2$ to 10 $g/m^2$. The presence of the byproducts such as oxide films and smuts is unfavorable when the aluminum pate is used as the aluminum support for the lithographic printing plate. As a step subsequent to the electrolytic polishing treatment, therefore, the chemical etching treatment in the acidic or alkaline aqueous solution, the electrolytic etching treatment using the aluminum plate as the cathode in the acidic or alkaline aqueous solution, or the desmutting treatment in the acidic aqueous solution is more preferably conducted.

If the state of the surface is uneven, the electrolytic polishing treatment is not uniformly performed. Accordingly, the chemical etching treatment in the acidic or alkaline aqueous solution, or the electrolytic etching treatment using the aluminum plate as the cathode in the acidic or alkaline aqueous solution is also more preferably conducted prior to the electrolytic polishing treatment.

Figure 5:
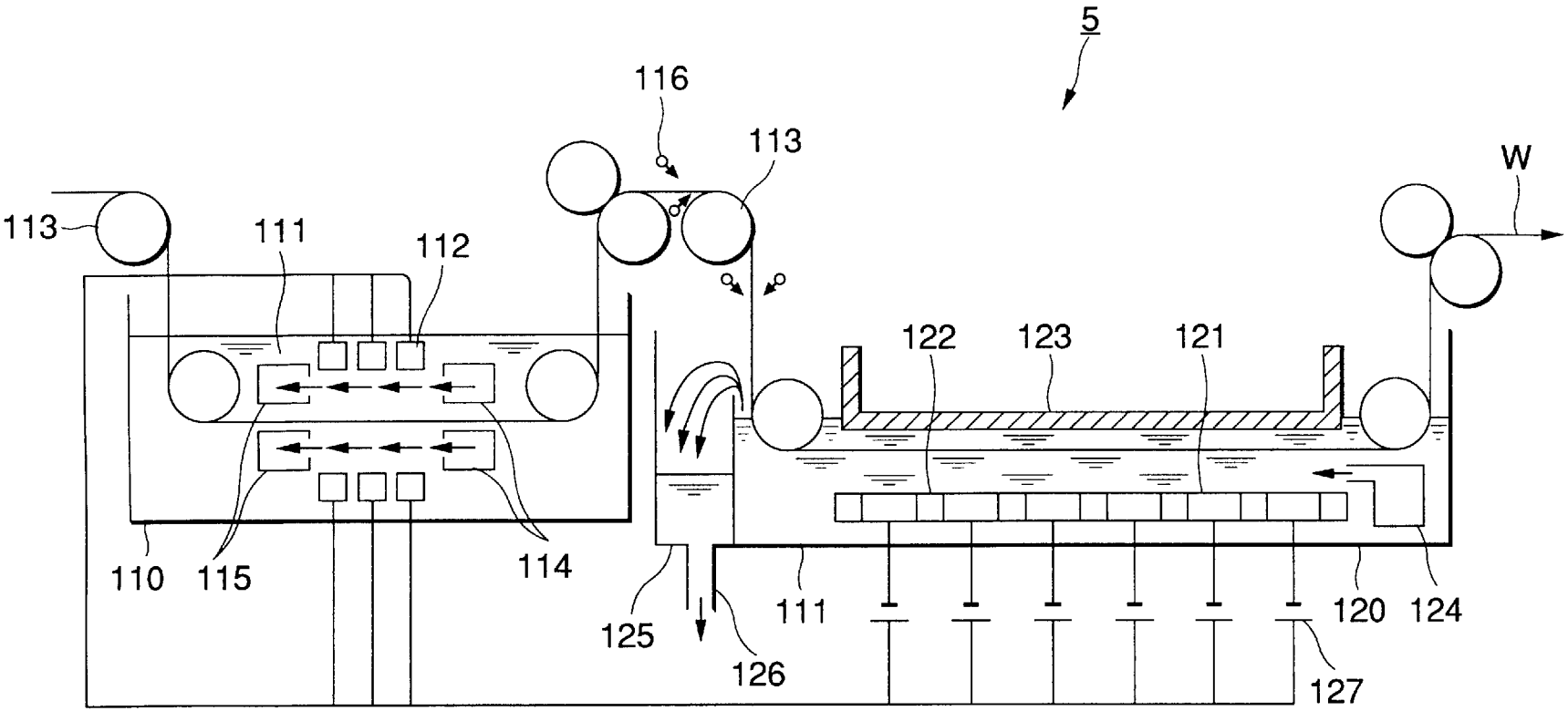
FIG. 5 is a schematic view showing one embodiment of an electrolytic polishing device for performing a method for producing an aluminum support for a lithographic printing plate according to the present invention.
Figure 6:
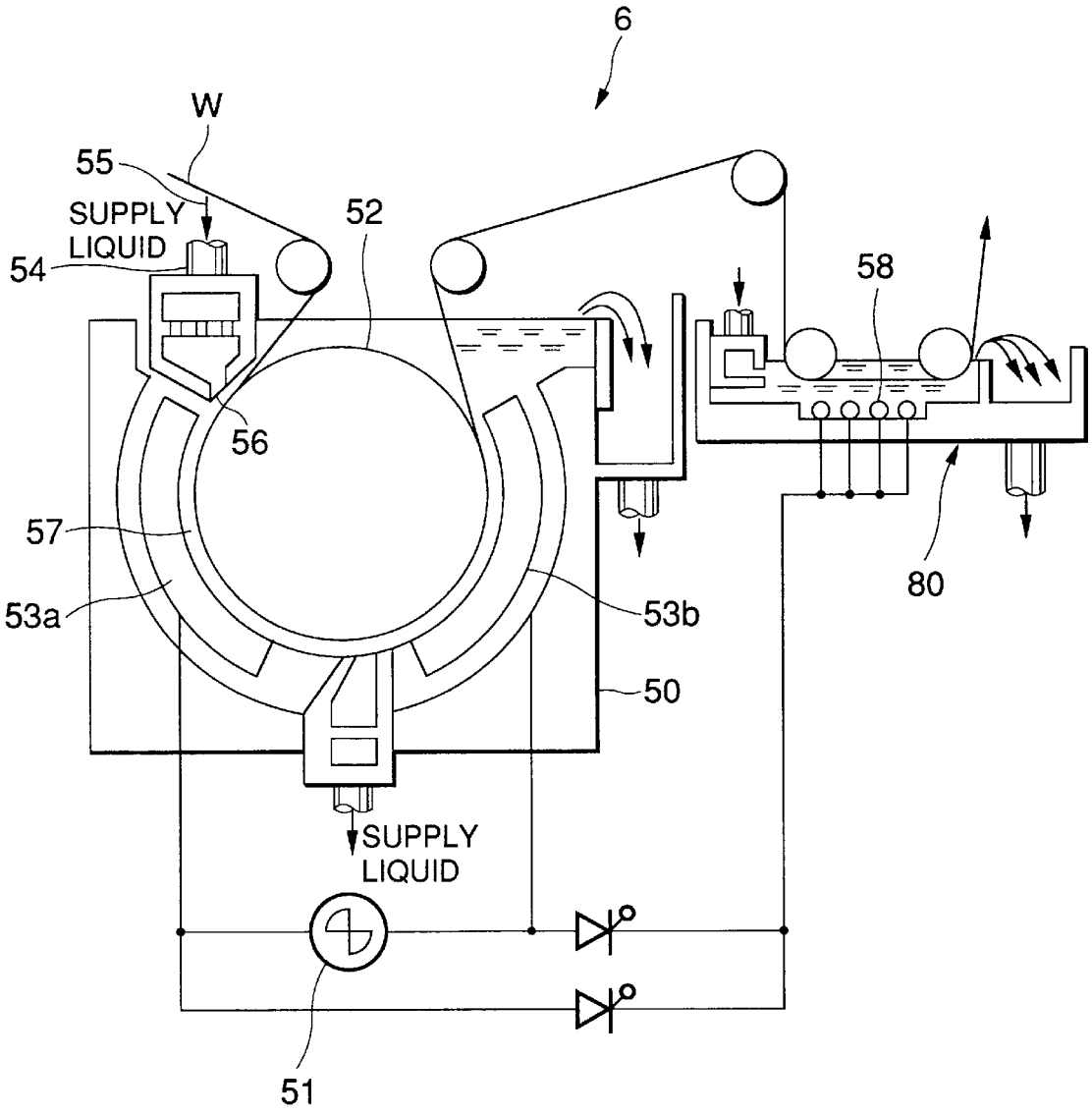
FIG. 6 is a schematic view showing a still further embodiment of a device used in electrochemical surface roughening in a method for producing an aluminum support for a lithographic printing plate according to the present invention, and used in electrochemical surface roughening using alternating current.

FIG. 5 is a schematic view showing one embodiment of a device suitable for performing the above-mentioned electrolytic polishing treatment.

As shown in the figure, an aluminum plate W is first fed to a feeder tank 110, and electrolyzed therein. The above-mentioned alkaline aqueous solution, an electrolyte 111, is stored in the electrolytic cell 110, and the aluminum plate W is conveyed by means of a path roll 113 so as to pass between anodes 112 arranged opposite to each other. The plural anodes 112 are connected to DC power supplies 127. Supplying nozzles 114 are disposed downstream from the anodes 112, and waste liquid outlets 115 are disposed upstream therefrom. The electrolyte (alkaline aqueous solution) 111 is sent out from the supplying nozzles 114 to the waste liquid outlets 115 so as to be allowed to flow through a space between the aluminum plate W and the anodes 112. The supplying nozzles 114 and the waste liquid outlets 115 are each arranged on both sides of the aluminum plate W.

The aluminum plate W carried out of the feeder tank 110 is then sent to an electrolytic polishing tank 120. At this time, in order to cool the aluminum plate W passing between the above-mentioned feeder tank 110 and the electrolytic polishing tank 120, the same electrolyte 111 as used in the electrolytic treatment is sprayed from spray nozzles 116.

The alkaline aqueous solution which is the electrolyte 111 is stored in the electrolytic polishing tank 120, and electrolytic treatment using the aluminum plate W as an anode is conducted. A plurality of divided cathodes 121 arranged opposite to the aluminum plate W are connected through insulators 122. Each of the cathodes is connected to each corresponding DC power supply 127. On the side of the aluminum plate W opposite to the cathodes 121, a sliding plate 123 is arranged for preventing back face flowing of current.

A supplying nozzle 124 is disposed downstream from the cathodes 121, and the electrolyte (alkaline aqueous solution) 111 is sent out from the supplying nozzle 124 so as to flow through a space between the aluminum plate W and the cathodes 121. An excess of the electrolyte 111 flowing out of the electrolytic polishing tank 120 by supply of the electrolyte 111 from the supplying nozzle 124 is sent to the outside of the system through an waste liquid outlet 126 of a waste liquid tank 125 equipped upstream from the electrolytic polishing tank 120.

[Electrolytic Etching Treatment Using Aluminum Plates as Cathodes in Alkaline Aqueous Solutions]

The term "electrolytic etching treatment" as used herein means a treating process in which aluminum plates are dissolved by electrolysis utilizing the process in which the aluminum plates act as cathodes when the liquid feeding system is used in the above-mentioned electrolytic polishing devices, and electrolytic treatment using aqueous solutions of alkaline substances such as sodium hydroxide, potassium hydroxide, sodium carbonate and sodium phosphate alone or mixtures thereof, mixtures of the alkaline substances and zinc hydroxide and aluminum hydroxide, or mixtures of these alkaline substances and salts such as sodium chloride and potassium chloride, and using the aluminum plates as the cathodes.

In this treatment, known aqueous solutions used in electrolytic polishing can be used, but aqueous solutions mainly containing sodium hydroxide are preferred. An aqueous solution containing 1% to 30% of sodium hydroxide is preferably used. The solution temperature is from 10° C. to 90° C. (preferably from 25° C. to 90° C., more preferably from 25° C. to 70° C., and particularly preferably 25° C. to 50° C.), the current density is from 1 $A/dm^2$ to 200 $A/dm^2$ (preferably from 1 $A/dm^2$ to 100 $A/dm^2$, more preferably from 5 $A/dm^2$ to 80 $A/dm^2$, and particularly preferably from 10 A/dm$^2$ to 80 A/dm$^2$), and the electrolytic time can be selected from the range of 1 second to 600 seconds, preferably 1 second to 180 seconds. To say nothing of aluminum, 0% to 10% by weight, preferably 9% to 5% by weight of an alloy component may be contained in an aluminum alloy. It is most preferred that the solution composition and the solution temperature are the same as those of the electrolytic polishing treatment in the alkaline aqueous solutions.

However, when the electrolytic polishing treatment in the alkaline aqueous solutions is performed under the solution conditions under which anode materials are extremely consumed, the treatment is preferably conducted under the electrolytic conditions satisfying at least one of temperature, concentration and current density lower than those of the electrolytic polishing treatment in the alkaline aqueous solutions.

Anode materials are preferably ferrite, platinum and iridium oxide.

[Electrolytic Etching Treatment Using Aluminum Plates as Cathodes in Acidic Aqueous Solutions]

This means a treating process in which aluminum plates are dissolved by electrolysis utilizing the process in which the aluminum plates act as cathodes in acidic aqueous solutions when the liquid feeding system is used in the above-mentioned electrolytic polishing devices.

In order to prevent the solutions from mixing with each other, it is preferred that a washing step intervenes between the treating process of dissolving the aluminum plate by electrolysis using the aluminum plate as the cathode in the acidic aqueous solution and the electrolytic polishing process in the alkaline aqueous solution.

As the acidic aqueous solution, phosphoric acid, nitric acid, sulfuric acid, chromic acid, hydrochloric acid or a mixed acid containing two or more of them can be used. The concentration of the acidic aqueous solution is preferably 0.5% to 65% by weight, and an aqueous solution containing 1% to 30% by weight of sulfuric acid or phosphoric acid is more preferred. The solution temperature is from 10° C. to 90° C. (preferably, from 25° C. to 70° C.), the current density is from 1 A/dm$^2$ to 200 A/dm$^2$ (preferably, from 5 A/dm$^2$ to 80 A/dm$^2$), and the electrolytic time can be selected from the range of 1 second to 180 seconds. To say nothing of aluminum, 0% to 10% by weight of an alloy component may be contained in an aluminum alloy.

The average flow rate between the aluminum plate and the electrode, which may be either a parallel flow or a counter flow to the aluminum plate, is preferably from 1 cm/second to 400 cm/second. The aluminum plate may be treated on one side or both sides.

Anode materials are preferably ferrite, platinum and iridium oxide.

[Chemical Etching Treatment in Acidic or Alkaline Aqueous Solutions]

The concentration of the alkaline aqueous solution is preferably from 1% to 30% by weight, and further, the amount of aluminum dissolved in the alkaline aqueous solution is preferably from 1% to 30% by weight. As the alkaline aqueous solution, an aqueous solution mainly containing sodium hydroxide is particularly preferred. The treatment is preferably conducted at a solution temperature of from ordinary temperature to 95° C. for 1 second to 120 seconds.

As an acid which can be used in the acidic aqueous solution, phosphoric acid, nitric acid, sulfuric acid, chromic acid, hydrochloric acid or a mixed acid containing two or more of them can be used. The concentration of the acidic aqueous solution is preferably from 0.5% to 65% by weight, and further, the amount of aluminum dissolved in the acidic aqueous solution is preferably from 0.5% to 5% by weight. The treatment is preferably conducted at a solution temperature of from 30° C. to 95° C. for 1 second to 120 seconds. As the acidic aqueous solution, sulfuric acid is particularly preferred.

The concentrations of sulfuric acid and aluminum are preferably selected from the range in which no deposition occurs at ordinary temperature.

After the etching treatment has been terminated, the removal of the solution with nip rolls and washing with water by spraying are preferably carried out, for preventing the treating solution from being brought in the subsequent step.

[Desmutting Treatment in Acidic Aqueous Solutions]

When the chemical etching treatment is conducted using the alkaline aqueous solutions, smuts are generally formed on the surface of aluminum. In this case, therefore, the desmutting treatment is conducted with phosphoric acid, nitric acid, sulfuric acid, chromic acid, hydrochloric acid or a mixed acid containing two or more of them.

The concentration of the acidic aqueous solution is preferably from 0.5% to 60% by weight, and further, the amount of aluminum dissolved in the acidic aqueous solution is preferably from 0% to 5% by weight. The treatment is preferably conducted at a solution temperature of from ordinary temperature to 95° C. for 1 second to 120 seconds. After the desmutting treatment has been terminated, the removal of the solution with nip rolls and washing with water by spraying are preferably carried out, for preventing the treating solution from being brought in the subsequent step.

[Mechanical Surface Roughening Treatment]

In mechanical surface roughening in the present invention, it is advantageous to mechanically roughen a surface of the aluminum plate with a rotating nylon brush roll have 0.2-mm to 1.61-mm, preferably 0.2-mm to 0.9-mm diameter bristles and a slurry supplied to the surface thereof. As abrasives, known ones can be used, and silica sand, quartz, aluminum hydroxide and mixtures thereof are preferred. They are described in detail in JP-A-6-135175 and JP-B-50-40047. The specific gravity of the slurry is preferably from 1.05 to 1.3.

Of course, a system of spraying a slurry, a system of using a wire brush and a system of transferring an uneven surface form of a rolling roll to an aluminum plate may be used. Other methods are described in JP-A-55-074898, JP-A-61-162351 and JP-A-63-104889.

[Solutions Mainly Containing Nitric Acid]

In the producing methods according to the present invention, as solutions mainly containing nitric acid, ones used in conventional electrochemical surface roughening treatment using direct current or alternating current can be used. At least one of hydrochloric acid or nitric acid compounds having nitric acid ions such as aluminum nitrate, sodium nitrate and ammonium nitrate and hydrochloric acid ions such as aluminum chloride, sodium chloride and ammonium chloride can be added in an amount of 1 g/liter to saturation to 1 to 110-g/liter aqueous solutions of nitric acid to use the resulting solutions.

Metals contained in aluminum alloys such as iron, copper, manganeses, nickel, titanium, magnesium and silica may be dissolved in the aqueous solutions mainly containing nitric acid. It is preferred that solutions obtained by adding aluminum chloride and aluminum nitrate to 0.5% to 2% by weight aqueous solutions of nitric acid so as to give an aluminum ion concentration of 3 g/liter to 50 g/liter are used. The temperature is preferably from 10° C. to 90° C., and more preferably from 40° C. to 80° C.

[Solutions Mainly Containing Hydrochloric Acid]

In the producing methods according to the present invention, as solutions mainly containing hydrochloric acid, ones used in conventional electrochemical surface roughening treatment using direct current or alternating current can be used. At least one of hydrochloric acid or nitric acid compounds having nitric acid ions such as aluminum nitrate, sodium nitrate and ammonium nitrate and hydrochloric acid ions such as aluminum chloride, sodium chloride and ammonium chloride can be added in an amount of 1 g/liter to saturation to 1 to 100-g/liter aqueous solutions of hydrochloric acid to use the resulting solutions.

Metals contained in aluminum alloys such as iron, copper, manganese, nickel, titanium, magnesium and silica may be dissolved in the aqueous solutions mainly containing hydrochloric acid. It is preferred that solutions obtained by adding aluminum chloride and aluminum nitrate to 0.5% to 2% by weight aqueous solutions of hydrochloric acid so as to give an aluminum ion concentration of 3 g/liter to 50 g/liter are used. The temperature is preferably from 10° C. to 60° C., and more preferably from 20° C. to 50° C. Hypochlorous acid may be added.

[Electrochemical Surface Roughening Using Alternating Current]

In the producing methods according to the present invention, as solutions mainly containing nitric acid, ones used in conventional electrochemical surface roughening treatment using direct current or alternating current can be used. Advantageously, they can be selected form the above-mentioned aqueous solutions mainly containing nitric acid or aqueous solutions mainly containing hydrochloric acid.

Electrochemical surface roughening in the aqueous solutions mainly containing nitric acid produces pits having an average diameter of 0.5 μm to 3 μm. However, when the quantity of electricity is relatively increased, the electrolytic reaction concentrates to result in formation of honeycomb pits having an average diameter exceeding 3 μm. As the quantity of electricity is established relatively high, the surface having large undulations is formed.

Electrochemical surface roughening in the aqueous solutions mainly containing hydrochloric acid produces square-like pits having a size of 0.1 μm to 0.5 μm. Further, as the quantity of electricity is established relatively high, the surface having large undulations is formed.

In order to make invisible streaks caused by the difference in orientation of crystal grains, it is preferred that honeycomb pits are densely formed. The ratio occupied by the honeycomb pits is preferably from 60% to 100%, and particularly preferably from 80% to 100%.

As to AC power supply waveforms used in electrochemical surface roughening, a sine wave, a rectangular wave, a trapezoidal wave and a triangular wave can be sued. A rectangular wave or a trapezoidal wave as shown in FIG. 9 is preferred, and a trapezoidal wave is particularly preferred.

Figure 9:
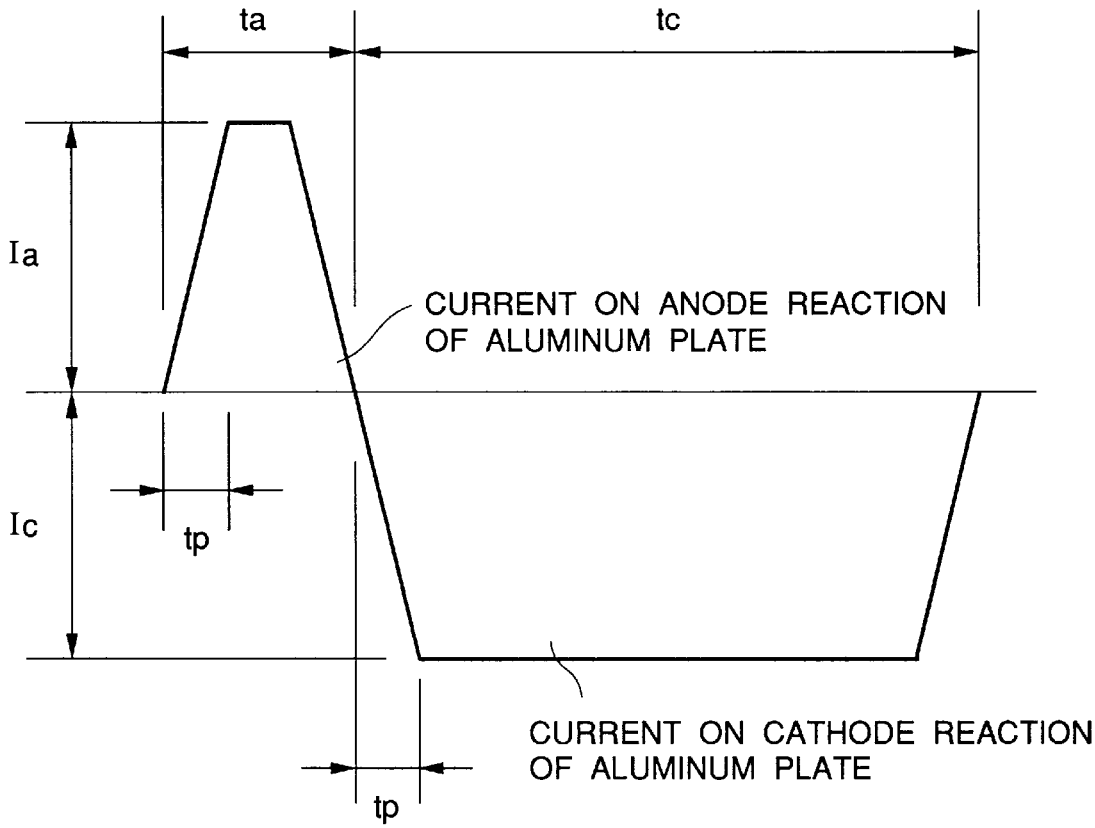
FIG. 9 is a schematic waveform diagram showing one example of an alternating current waveform used in electrochemical surface roughening treatment using alternating current.

In the trapezoidal wave shown in FIG. 9, the time tp required until the current reaches a peak from 0 is preferably from 1 millisecond to 10 milliseconds. If the tp is less than 1 millisecond, a high power supply voltage becomes necessary in rising of a current waveform because of the influence of impedance of a power circuit, resulting in high installation cost of the power supply. Exceeding 10 milliseconds results in a tendency to be influenced by trace components contained in the electrolyte, which causes difficulty in performing uniform surface roughening.

With respect to the conditions of one cycle of alternating current used in electrochemical surface roughening, The ratio tc/ta of the cathode reaction time tc to the anode reaction time ta of the aluminum plate is preferably from 1 to 20, the ratio Qc/Qa of the quantity of electricity Qc at the time when the aluminum plate is the cathode to the quantity of electricity Qa at the time when the aluminum is the anode is preferably from 0.3 to 20, and the anode reaction time ta is preferably within the range of 5 milliseconds to 1000 milliseconds. It is more preferred that tc/ta is from 2.5 to 15.

It is more preferred that Qc/Qa is from 2.5 to 15. For forming uniform honeycomb pits on the surface of the aluminum plate, a balance between the distribution of oxide films on the surface of the aluminum plate and how smuts mainly composed of aluminum hydroxide are formed becomes important. The distribution of the oxide films means the distribution of initiation points of pitting reaction in the anode reaction of the aluminum plate. How smuts are formed bears an important role for preventing the pitting reaction from occurring again on portions on which the pitting reaction has once occurred, thereby dispersing the honeycomb pits. When the aluminum plate undergoes the anode reaction, the aluminum ion concentration in the vicinity of the interface at which the reaction occurs becomes rich to precipitate aluminum hydroxide.

Further, when the aluminum plate undergoes the cathode reaction, a hydrogen gas is produced to convert the pH of the interface to the aluminum precipitating range, which causes precipitation. In particular, the smuts are liable to be precipitated on portions where pitting is conducted in the anode reaction just before the cathode reaction, and formed so as to cover the pits. Current is therefore difficult to flow in those portions, so that the concentration of current is prevented. On the surface of the aluminum plate which has been electrochemically roughened, honeycomb pits having an average diameter of 0.5 μm to 3 μm are uniformly formed when 0.8 $g/m^2$ or more of smuts mainly composed of aluminum hydroxide are formed.

If the tc/ta is less than 1, the initiation points of pitting reaction caused by dissolution of the oxide films formed by the anode reaction of the aluminum plate are decreased, resulting in failure to form uniform honeycomb pits. If the tc/ta exceeds 20, the oxide films formed by the anode reaction of the aluminum plate are dissolved too much. Accordingly, the initiation points of pitting reaction are too much increased to form uniform honeycomb pits, leading to no increase in surface area. If the Qc/Qa is less than 0.3, the initiation points of pitting reaction caused by dissolution of the oxide films formed by the anode reaction of the aluminum plate are decreased, resulting in failure to form uniform honeycomb pits. If the Qc/Qa exceeds 20, the oxide films formed by the anode reaction of the aluminum plate are dissolved too much. Accordingly, the initiation points of pitting reaction are too much increased to form uniform honeycomb pits, leading to no increase in surface area.

The current density is preferably from 10 $A/dm^2$ to 1000 $A/dm^2$ on both the anode cycle side Ia and the cathode cycle side Ic of current in the peak value of the trapezoidal wave. It is preferred that the Ic/Ia ranges from 0.3 to 20.

The total quantity of electricity taking part in the anode reaction of the aluminum plate at the time when the electrochemical roughening is terminated is preferably from 10 $C/dm^2$ to 1000 $C/dm^2$, and particularly preferably from 100 $C/dm^2$ to 600 $C/dm^2$.

As the electrolytic cells used in the electrochemical roughening using alternating current in the producing methods according to the present invention, known electrolytic cells used in surface treatment such as vertical type, flat type and radial type electrolytic cells can be used. However, radial type electrolytic cells as described in JP-A-5-195300 are particularly preferred. The electrolytes passing through the electrolytic cells may be either parallel with or counter to the advance of the aluminum webs. One or more AC power supplies can be connected to one electrolytic cell.

In the electrochemical surface roughening using alternating current, a device shown in FIG. 6 can be used. An aluminum plate W is wound around a radial drum roll 52 immersed in a main electrolytic cell 50, and electrolyzed in the course of its conveyance with main electrodes 53*a* and 53*b* connected to an AC power supply 51. An electrolyte 55 is supplied from an electrlyte supplying inlet 54 to an electrlyte passage 57 between the radium drum roll 52 and the main electrodes 53*a* and 53*b* through a slit 56.

The aluminum plate W treated in the main electrolytic cell 50 is then electrolyzed in an auxiliary anode tank 57. In this auxiliary anode tank 57, auxiliary anodes 58 are arranged opposite to the aluminum plate W, and the electrolyte 55 is supplied so as to flow through a space between the auxiliary anodes 58 and the aluminum plate W.

[Electrochemical Roughening Using Direct Current]

The term "surface roughening treatment using direct current" as used in the present invention means a process of applying direct current between an aluminum plate and an electrode opposite thereto to electrochemically roughening a surface of the aluminum plate. As the electrolytes, known ones used in electrochemical surface roughening treatment using direct current or alternating current can be used. Advantageously, they can be selected from the above-mentioned aqueous solutions mainly containing hydrochloric acid. The temperature is preferably from 10° C. to 80° C. Although known treating devices using direct current can be used in the electrochemical surface roughening using direct current, a device having one or more pairs of anodes and cathodes alternately arranged as described in JP-A-1-141094 is preferably used. Examples of the known devices are described in JP-A-6-328876, JP-A-8-67078, JP-A-61-19115 and JP-B-57-44760.

Further, direct current may be applied between a feeder roll in contact with an aluminum plate and a cathode opposite thereto to conduct electrochemical surface roughening treatment using the aluminum plate as an anode. After the electrolytic treatment has been terminated, the removal of the solution with nip rolls and washing with water by spraying are preferably carried out, for preventing the treating solution from being brought in the subsequent step.

In the electrochemical surface roughening, direct current having a ripple percentage of 20% or less is preferably used. The current density is preferably from 10 A/dm$^2$ to 200 A/dm$^2$, and the quantity of electricity at the time when the aluminum plate is an anode is preferably from 100 C/dm$^2$ to 1000 C/dm$^2$. The anodes can be selected from known electrodes for oxygen generation, for example, ferrite, iridium oxide, platinum and valve metals such as titanium, niobium and zirconium clad or plated with platinum. The cathodes can be selected from carbon, platinum, titanium, niobium, zirconium, stainless steel and cathodes for fuel cells.

[Anodizing Treatment]

In order to enhance the wear resistance of the surfaces of the aluminum plates, anodizing treatment is conducted. In the anodizing treatment of the aluminum plates, any electrolytes can be used as long as they form porous oxide films. In general, sulfuric acid, phosphoric acid, oxalic acid, chromic acid or a mixed solution thereof is used. The concentration of the electrolyte is appropriately determined according to the kind of electrolyte. Anodizing conditions can not be specified without reservation, because they vary depending on the kind of electrolyte. However, an electrolyte concentration within the range of 1% to 80% by weight, a solution temperature within the range of 5° C. to 70° C., a current density within the range of 1 A/dm$^2$ to 60 A/dm$^2$, a voltage within the range of 1 V to 100 V and an electrolytic time within the range of 10 seconds to 300 seconds are generally proper.

In the sulfuric acid process, the treatment is usually performed by use of direct current. However, it is also possible to use alternating current. The amount of anodic oxide films is properly from 1 g/m$^2$ to 10 g/m$^2$. Less than 1 g/m$^2$ results in sufficient printing durability or easy development of scratches is non-image areas of the lithographic printing plates, which concurrently causes a tendency to form so-called scratching stains due to adhesion of ink to the scratches.

After the anodizing treatment, the aluminum surface is hydrophilized if necessary. The hydrophilizing treatment used in the present invention includes an alkali metal silicate (for example, an aqueous solution of sodium silicate) process as described in U.S. Pat. Nos. 2,714,066, 3,181,461, 3,280,734 and 3,902,734. In this process, the support is immersed or electrolyzed in the aqueous solution of sodium silicate. In addition, a process of treating the support with potassium fluorozirconate disclosed in JP-B-36-22063, or polyvinyl-phosphonic acid as disclosed in U.S. Pat. Nos. 3,276,868, 4,153,461 and 4,689,272 is used.

After gaining treatment and the anodizing treatment, sealing treatment is preferably performed. Such sealing treatment is conducted by immersion in a hot water solution containing hot water and an inorganic or organic salt, and by a steam bath.

The aluminum plates surface roughened by the producing methods according to the present invention are supports satisfying properties described in Japanese Patent Application Nos. 8-296708 and 8-176568.

Specifically, the supports satisfies the following surface properties.

(1) The surface shape defined by use of values measured under an atomic force microscopy (AFM) is within the following range.

(a) Using an AFM in which the resolution in horizontal directions (X, Y) is 0.1 $\mu$m, the surface area is measured in the range of 100 $\mu$m square by the approximate three-point method. When the surface area is taken as a and an upper projected area as b, the ratio of a/b (specific surface area) is from 1.15 to 1.5.

(b) Using an AFM in which the resolution in horizontal directions (X, Y) is 1.0 $\mu$m, the average surface roughness is measured in the range of 240 $\mu$m square. The average surface roughness is from 0.35 $\mu$m to 1.0 $\mu$m.

(c) Using an AFM in which the resolution in horizontal directions (X, Y) is 1.9 $\mu$m, the degree of inclination is measured in the range of 240 $\mu$m square. The ratio of the degree of inclination of 30 degrees or more is from 5% to 40%.

(d) For the supports for lithographic printing plates, whose surfaces have undulations by surface roughening, the degree of surface inclination is measured under an AFM at a resolution of 0.1 $\mu$m in 50 $\mu$m square. The ratio of the degree of inclination of 45 degrees or more is from 5% to 50%.

(2) The 85-degree glossiness before coating of the photosensitive layer defined in JIS Z9741-1983 is 30 or less.

(3) When observed under a scanning electron microscope at a magnification of 750, the ratio of an area occupied by honeycomb pits having an average diameter of 0.1 μm to 3 μm in a 80-μm field of view is from 30% to 100%.

(4) Using an AFM in which the resolution in horizontal directions (X, Y) is 0.1 μm or 1.9 μm, the fractal dimension is measured in the range of 100 μ square or 240 μm square. The fractal dimension determined by the box counting method, the scale conversion method, the cover method, the radius of gyration method and the density correlation function method is from 2.1 to 2.5.

In particular, with respect to the density of honeycomb pits formed by electrochemical surface roughening using direct current or alternating current, in the case that the ratio of an area occupied by the honeycomb pits having an average diameter of 0.1 μm to 3 μm in a 80-μm field of view is from 60% to 100%, and more preferably from 80% to 100% when observed under a scanning electron microscope at a magnification of 750, generation of the treatment unevenness caused by crystal grains can be minimized.

Examples of the methods for producing aluminum supports for lithographic printing plates according to the present invention are described below.

EXAMPLE 1

An aluminum plate of JIS A 1050 having a thickness of 0.24 mm and a width of 1030 mm in which soaking and process annealing were omitted and streaks were liable to be developed by chemical etching in an acidic or alkaline aqueous solution was continuously treated.

(1) Mechanical Surface Roughening Treatment

The aluminum plate was mechanically roughened with rotational roller-like nylon brushes while feeding a suspension of aluminum hydroxide having a specific gravity of 1.12 and water as an abrasive slurry to a surface of the aluminum plate. As a material of the nylon brushes, nylon 610 was used. The length of bristles was 50 mm, and the diameter thereof was 0.295 mm. The nylon brush was produced by drilling holes in a stainless steel cylinder having a diameter of 300 mm and densely transplanting bristles thereto. Three rotational brushes were used. The distance of two support rolls (200 mm in diameter) under the brush was 300 mm. The brush roll was pressed until the load of a driving motor for rotating the brush reached +6 kw based on the load before the brush roll was pressed to the aluminum plate. The rotational direction of the brushes was the same as the travelling direction of the aluminum plate. Then, the aluminum plate was washed with water. The travelling speed of the aluminum plate was 50 m/minute.

(2) Electrolytic polishing Treatment in Alkaline Aqueous Solution

The aluminum plate was electropolished in an aqueous solution containing 5% by weight of sodium hydroxide at 35° C., using the aluminum plate as an anode at a current density of 30 A/dm$^2$. The amount of the aluminum plate dissolved was 5 g/m$^2$.

Then, the aluminum plate was washed with water by use of a spray.

(3) Chemical Etching Treatment in Acidic Aqueous Solution

Then, the aluminum plate was immersed in an aqueous solution containing 25% by weight of sulfuric acid at 60° C. for 120 seconds to conduct chemical etching treatment, followed by washing with water.

(4) Electrochemical Surface Roughening Treatment

Electrochemical surface roughening treatment was continuously conducted using alternating voltage. The device shown in FIG. 6 was used. An electrolyte used at this time was a 1 wt % aqueous solution of nitric acid (containing 0.5% by weight of aluminum ions and 0.007% by weight of ammonium ions), and the solution temperature was 45° C. In an alternating voltage waveform, the time tp required until the current value reached a peak from 0 was 1 millisecond, and the duty ratio was 1:1. Using trapezoidal rectangular wave alternating current, and using a carbon electrode as a counter electrode, the electrochemical surface roughening treatment was conducted. As an auxiliary anode, ferrite was used.

The current density was 60 A/dm$^2$ in the peak value of current, and the total quantity of electricity was 200 C/dm$^2$ when the aluminum plate was an anode. To the auxiliary electrode, 5% of the current flowing from the power supply was shunted.

Then, the aluminum plate was washed with water by use of a spray.

(5) Electrolytic polishing Treatment in Alkaline Aqueous Solution

The aluminum plate was electropolished in an aqueous solution containing 5% by weight of sodium hydroxide at 35° C., using the aluminum plate as an anode at a current density of 30 A/dm$^2$. The amount of the aluminum plate dissolved was 1 g/m$^2$.

Then, the aluminum plate was washed with water by use of a spray.

(6) Chemical Etching Treatment in Acidic Aqueous Solution

Then, the aluminum plate was immersed in an aqueous solution containing 25% by weight of sulfuric acid at 60° C. for 120 seconds to conduct chemical etching treatment, followed by washing with water.

(7) Anodizing Treatment

Anodizing treatment was conducted with a 15 wt % aqueous solution of sulfuric acid (containing 0.5% by weight of aluminum ions) at a solution temperature of 35° C., using direct current voltage, so as to give an amount of anodic oxide films of 2.4 g/m$^2$ at a current density of 2 A/dm$^2$. Then, the aluminum plate was washed with water by use of a spray.

The surface of the aluminum plate thus treated was visually observed. As a result, streaks caused by the orientation of crystal grains were not observed.

This aluminum plate was coated with an intermediate layer and a photosensitive layer, followed by drying to prepare a positive type presensitized plate having a dry film thickness of 2.0 g/m$^2$. Printing using this presensitized plate gave a good printing plate.

EXAMPLE 2

The substrate after the anodizing treatment obtained in Example 1 was immersed in a 2.5 wt % aqueous solution of sodium silicate at 70° C. for 14 seconds, for conducting hydrophilizing treatment, followed by washing with water by use of a spray and drying. After each treatment and washing, the solution was removed with nip rolls.

This treated aluminum plate was coated with an intermediate layer and a negative type photosensitive layer, followed by drying to prepare a presensitized plate. Printing of this presensitized plate gave a good printing plate.

On the surface of this aluminum plate, streaks caused by the orientation of crystal grains were not developed.

EXAMPLE 3

As the slurry used in the mechanical polishing treatment of Example 1, (1), a liquid mainly containing silica sand was used. The specific gravity was 1.12. The treatment was conducted in the same manner as with Example 1 with the exception that the amount of aluminum dissolved in Example 1, (2) was changed to 8 g/m$^2$. On the surface of this aluminum plate, streaks caused by the orientation of crystal grains were not developed.

This aluminum plate was coated with a intermediate layer and a photosensitive layer, followed by drying to prepare a positive type presensitized plate having a dry film thickness of 2.0 g/m$^2$. Printing using this presensitized plate gave a good printing plate.

EXAMPLE 4

The substrate after the anodizing treatment obtained in Example 3 was immersed in a 2.5 wt % aqueous solution of sodium silicate at 70° C. for 14 seconds, for conducting hydrophilizing treatment, followed by washing with water by use of a spray and drying. After each treatment and washing, the solution was removed with nip rolls.

This treated aluminum plate was coated with an intermediate layer and a negative type photosensitive layer, followed by drying to prepare a presensitized plate. Printing of this presensitized plate gave a good printing plate.

On the surface of this aluminum plate, streaks caused by the orientation of crystal grains were not developed.

EXAMPLE 5

An aluminum plate of JIS A 1050 having a thickness of 0.24 mm and a width of 1030 mm in which soaking and process annealing were omitted and streaks were liable to be developed by chemical etching in an acidic or alkaline aqueous solution was continuously treated. The device shown in FIG. 4 was used for electrolytic polishing treatment.

(1) Mechanical Surface Roughening Treatment

The aluminum plate was mechanically roughened with rotational roller-like nylon brushes while feeding a suspension of aluminum hydroxide having a specific gravity of 1.12 and water as an abrasive slurry to a surface of the aluminum plate. As a material of the nylon brushes, nylon 610 was used. The length of bristles was 50 mm, and the diameter thereof was 0.295 mm.

The nylon brush was produced by drilling holes in a stainless steel cylinder having a diameter of 300 mm and densely transplanting bristles thereto. Three rotational brushes were used. The distance of two support rolls (200 mm in diameter) under the brush was 300 mm. The brush roll was pressed until the load of a driving motor for rotating the brush reached +6 kw based on the load before the brush roll was pressed to the aluminum plate. The rotational direction of the brushes was the same as the travelling direction of the aluminum plate. Then, the aluminum plate was washed with water. The travelling speed of the aluminum plate was 50 m/minute.

(2) Chemical Etching Treatment in Alkaline Aqueous Solution

The aluminum plate was immersed in an aqueous solution containing 26% by weight of NaOH and 6.5% by weight of aluminum ions at 60° C. to etch the aluminum plate. The amount of the aluminum plate dissolved was 5 g/m$^2$.

Then, the aluminum plate was washed with water.

(3) Desmutting Treatment in Acidic Aqueous Solution

Then, the aluminum plate was immersed in an aqueous solution containing 1% by weight of nitric acid at 30° C. for 10 seconds to conduct desmutting treatment, followed by washing with water.

(4) Electrochemical Surface Roughening Treatment

Electrochemical surface roughening treatment was continuously conducted using alternating voltage. The device shown in FIG. 6 was used. An electrolyte used at this time was a 1 wt % aqueous solution of nitric acid (containing 0.5% by weight of aluminum ions and 0.007% by weight of ammonium ions), and the solution temperature was 45° C. In a alternating voltage waveform, the time tp required until the current value reached a peak from 0 was 1 millisecond, and the duty ratio was 1:1. Using trapezoidal rectangular wave alternating current, and using a carbon electrode as a counter electrode, the electrochemical surface roughening treatment was conducted. As an auxiliary anode, ferrite was used.

The current density was 60 A/dm$^2$ in the peak value of current, and the total quantity of electricity was 200 C/dm$^2$ when the aluminum plate was an anode. To the auxiliary anode, 5% of the current flowing from the power supply was shunted.

Then, the aluminum plate was washed with water by use of a spray.

(5) Electrolytic polishing Treatment in Alkaline Aqueous Solution

The aluminum plate was electropolished in an aqueous solution containing 5% by weight of sodium hydroxide at 35° C., using the aluminum plate as an anode at a current density of 30 A/dm$^2$. The amount of the aluminum plate dissolved was 0.6 g/m$^2$.

Then, the aluminum plate was washed with water by use of a spray.

Figure 4:
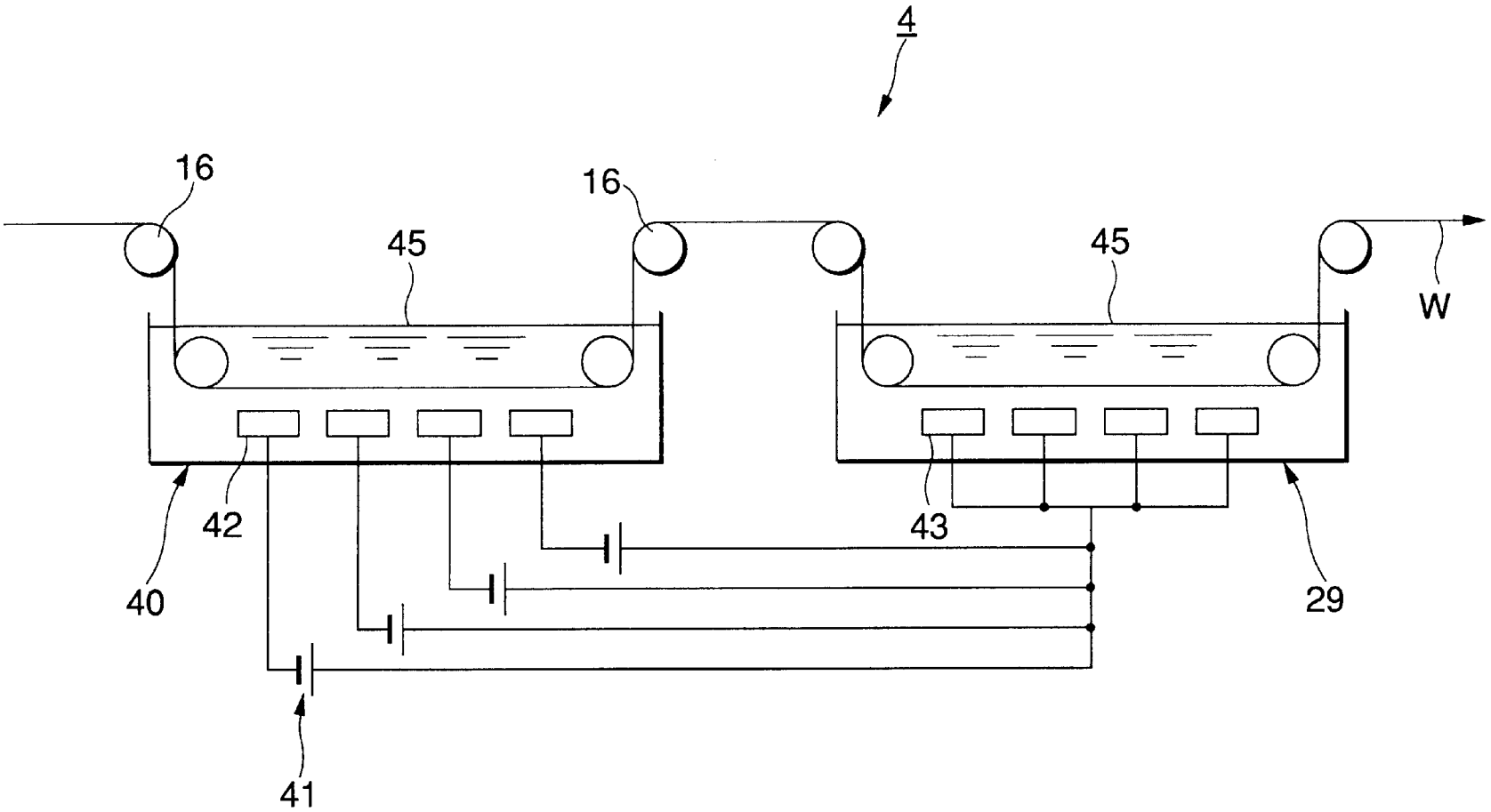
FIG. 4 is a view showing a further embodiment of a device used in electrolytic polishing in a method for producing an aluminum support for a lithographic printing plate according to the present invention.

(6) Electrolytic Etching Treatment in Alkaline Aqueous Solution Using Aluminum Plate as Cathode The electrolytic cell (feeder tank) with the anodes arranged in the electrolytic polishing treatment step shown in FIG. 4 was utilized, and the aluminum plate was used as the cathode to conduct electrolysis. In the meantime, electrolytic etching treatment was performed. As the electrolyte, an aqueous solution containing 5% by weight of NaOH was used at 35° C. The amount of the aluminum plate dissolved was 0.4 g/m$^2$.

(7) Desmutting Treatment in Acidic Aqueous Solution

Then, the aluminum plate was immersed in an aqueous solution containing 15% by weight of sulfuric acid (this solution contained 0.5% by weight of aluminum ions) at 45° C. for 5 seconds to conduct desmutting treatment, followed by washing with water.

(8) Anodizing Treatment

Anodizing treatment was conducted with a 15 wt % aqueous solution of sulfuric acid (this solution contained 0.5% by weight of aluminum ions) at a solution temperature of 35° C., using direct current voltage, so as to give an amount of anodic oxide films of 2.4 g/m$^2$ at a current density of 2 A/dm$^2$. Then, the aluminum plate was washed with water by use of a spray.

The surface of the aluminum plate thus treated was visually observed. As a result, streaks caused by the orientation of crystal grains were not observed.

This aluminum plate was coated with an intermediate layer and a photosensitive layer, followed by drying to prepare a positive type presensitized plate having a dry film thickness of 2.0 g/m$^2$. Printing using this presensitized plate gave a good printing plate.

EXAMPLE 6

An aluminum plate of JIS A 1050 having a thickness of 0.24 mm and a width of 1030 mm in which soaking and process annealing were omitted and streaks were liable to be developed by chemical etching in an acidic or alkaline aqueous solution was continuously treated. The device shown in FIG. 3 was used for electrolytic polishing treatment.

(1) Mechanical Surface Roughening Treatment

The aluminum plate was mechanically roughened with rotational roller-like nylon brushes while feeding a suspension of aluminum hydroxide having a specific gravity of 1.12 and water as an abrasive slurry to a surface of the aluminum plate. As a material of the nylon brushes, nylon 610 was used. The length of bristles was 50 mm, and the diameter thereof was 0.295 mm. The nylon brush was produced by drilling holes in a stainless steel cylinder having a diameter of 300 mm and densely transplanting bristles thereto. Three rotational brushes were used. The distance of two support rolls (200 mm in diameter) under the brush was 300 mm. The brush roll was pressed until the load of a driving motor for rotating the brush reached +6 kw based on the load before the brush roll was pressed to the aluminum plate. The rotational direction of the brushes was the same as the travelling direction of the aluminum plate. Then, the aluminum plate was washed with water. The travelling speed of the aluminum plate was 50 m/minute.

(2) Chemical Etching Treatment in Alkaline Aqueous Solution

The aluminum plate was immersed in an aqueous solution containing 26% by weight of NaOH and 6.5% by weight of aluminum ions at 60° C. to etch the aluminum plate. The amount of the aluminum plate dissolved was 5 g/m$^2$.

Then, the aluminum plate was washed with water.

(3) Desmutting Treatment in Acidic Aqueous Solution

Then, the aluminum plate was immersed in an aqueous solution containing 1% by weight of nitric acid at 30° C. for 10 seconds to conduct desmutting treatment, followed by washing with water.

(4) Electrochemical Surface Roughening Treatment

Electrochemical surface roughening treatment was continuously conducted using alternating voltage. The device shown in FIG. 5 was used. An electrolyte used at this time was a 1 wt % aqueous solution of nitric acid (containing 0.5% by weight of aluminum ions and 0.007% by weight of ammonium ions), and the solution temperature was 45° C. In a alternating voltage waveform, the time tp required until the current value reached a peak from 0 was 1 millisecond, and the duty ratio was 1:1. Using trapezoidal rectangular wave alternating current, and using a carbon electrode as a counter electrode, the electrochemical surface roughening treatment was conducted. As an auxiliary anode, ferrite was used.

The current density was 60 A/dm$^2$ in the pak value of current, and the total quantity of electricity was 200 C/dm$^2$ when the aluminum plate was an anode. To the auxiliary anode, 5% of the current flowing from the power supply was shunted.

Then, the aluminum plate was washed with water by use of a spray.

(5) Electrolytic Etching Treatment in Alkaline Aqueous Solution Using Aluminum Plate as Cathode The electrolytic cell (feeder tank A) with the anodes arranged in the electrolytic polishing treatment step shown in FIG. 3 was utilized, and the aluminum plate was used as the cathode to conduct electrolysis. In the meantime, electrolytic etching treatment was performed. As the electrolyte, an aqueous solution containing 5% by weight of NaOH was used at 35° C. The amount of the aluminum plate dissolved was 0.4 g/m$^2$.

(6) Electrolytic polishing Treatment in Alkaline Aqueous Solution

The aluminum plate was electropolished in an aqueous solution containing 5% by weight of sodium hydroxide at 35° C., using the aluminum plate as an anode at a current density of 30 A/dm$^2$. The amount of the aluminum plate dissolved was 1 g/m$^2$.

Then, the aluminum plate was washed with water by use of a spray.

(7) Electrolytic Etching Treatment in Alkaline Aqueous Solution Using Aluminum Plate as Cathode The electrolytic cell (feeder tank B) with the anodes arranged in the electrolytic polishing treatment step shown in FIG. 3 was utilized, and the aluminum plate was used as the cathode to conduct electrolysis. In the meantime, electrolytic etching treatment was performed. As the electrolyte, an aqueous solution containing 5% by weight of NaOH was used at 35° C. The amount of the aluminum plate dissolved was 0.2 g/m$^2$.

(8) Desmutting Treatment in Acidic Aqueous Solution

Then, the aluminum plate was immersed in an aqueous solution containing 15% by weight of sulfuric acid (containing 0.5% by weight of aluminum ions) at 35° C. for 5 seconds to conduct desmutting treatment, followed by washing with water.

(9) Anodizing Treatment

Anodizing treatment was conducted with a 15 wt % aqueous solution of sulfuric acid (containing 0.5% by weight of aluminum ions) at a solution temperature of 35° C., using direct current voltage, so as to give an amount of anodic oxide films of 2.4 g/m$^2$ at a current density of 2 A/dm$^2$.

Then, the aluminum plate was washed with water by use of a spray.

The surface of the aluminum plate thus treated was visually observed. As a result, streaks caused by the orientation of crystal grains were not observed.

This aluminum plate was coated with an intermediate layer and a photosensitive layer, followed by drying to prepare a positive type presensitized plate having a dry film thickness of 2.0 g/m$^2$. Printing using this presensitized plate gave a good printing plate.

EXAMPLE 7

An aluminum plate of JIS A 1050 having a thickness of 0.24 mm and a width of 1030 mm in which soaking and process annealing were omitted and streaks were liable to be developed by chemical etching in an acidic or alkaline aqueous solution was continuously treated. The device shown in FIG. 2 was used for electrolytic polishing treatment.

(1) Mechanical Surface Roughening Treatment

The aluminum plate was mechanically roughened with rotational roller-like nylon brushes while feeding a suspension of aluminum hydroxide having a specific gravity of 1.12 and water as an abrasive slurry to a surface of the aluminum plate. As a material of the nylon brushes, nylon 610 was used. The length of bristles was 50 mm, and the diameter thereof was 0.295 mm. The nylon brush was produced by drilling holes in a stainless steel cylinder having a diameter of 300 mm and densely transplanting bristles thereto. Three rotational brushes were used.

The distance of two support rolls (200 mm in diameter) under the brush was 300 mm. The brush roll was pressed until the load of a driving motor for rotating the brush reached +6 kw based on the load before the brush roll was pressed to the aluminum plate. The rotational direction of the brushes was the same as the travelling direction of the aluminum plate. Then, the aluminum plate was washed with water. The travelling speed of the aluminum plate was 50 m/minute.

(2) Chemical Etching Treatment in Alkaline Aqueous Solution

The aluminum plate was immersed in an aqueous solution containing 26% by weight of NaOH and 6.5% by weight of aluminum ions at 60° C. to etch the aluminum plate. The amount of the aluminum plate dissolved was 5 g/m$^2$.

Then, the aluminum plate was washed with water.

(3) Desmutting Treatment in Acidic Aqueous Solution

Then, the aluminum plate was immersed in an aqueous solution containing 1% by weight of nitric acid at 30° C. for 10 seconds to conduct desmutting treatment, followed by washing with water.

(4) Electrochemical Surface Roughening Treatment

Electrochemical surface roughening treatment was continuously conducted using alternating voltage. The device shown in FIG. 6 was used. An electrolyte used at this time was a 1 wt% aqueous solution of nitric acid (containing 0.5% by weight of aluminum ions and 0.007% by weight of ammonium ions), and the solution temperature was 45° C. In a alternating voltage waveform, the time tp required until the current value reached a peak from 0 was 1 millisecond, and the duty ratio was 1:1. Using trapezoidal rectangular wave alternating current, and using a carbon electrode as a counter electrode, the electrochemical surface roughening treatment was conducted. As an auxiliary anode, ferrite was used.

The current density was 60 A/dm$^2$ in the peak value of current, and the total quantity of electricity was 200 C/dm$^2$ when the aluminum plate was an anode. To the auxiliary anode, 5% of the current flowing from the power supply was shunted.

Then, the aluminum plate was washed with water by use of a spray.

(5) Electrolytic Etching Treatment in Alkaline Aqueous solution using Aluminum Plate as Cathode The electrolytic cell (feeder tank) with the anodes arranged in the electrolytic polishing treatment step shown in FIG. 2 was utilized, and the aluminum plate was used as the cathode to conduct electrolysis. In the meantime, electrolytic etching treatment was performed. As the electrolyte, an aqueous solution containing 5% by weight of NaOH was used at 35° C. The amount of the aluminum plate dissolved was 0.4 g/m$^2$.

(6) Electrolytic polishing Treatment in Alkaline Aqueous Solution the aluminum plate was electropolished in an aqueous solution containing 5% by weight of sodium hydroxide at 35° C., using the aluminum plate as an anode at a current density of 30 A/dm$^2$. The amount of the aluminum plate dissolved was 0.6 g/m$^2$.

Then, the aluminum plate was washed with water by use of a spray.

(7) Chemical Etching Treatment in Acidic Aqueous Solution

Then, the aluminum plate was immersed in an aqueous solution containing 25% by weight of sulfuric acid at 60° C. for 120 seconds to conduct chemical etching treatment, followed by washing with water.

(8) Anodizing Treatment

Anodizing treatment was conducted with a 15 wt% aqueous solution of sulfuric acid (containing 0.5% by weight of aluminum ions) at a solution temperature of 35° C., using direct current voltage, so as to give an amount of anodic oxide films of 2.4 g/m$^2$ at a current density of 2 A/dm$^2$.

Then, the aluminum plate was washed with water by use of a spray.

The surface of the aluminum plate thus treated was visually observed. As a result, streaks caused by the orientation of crystal grains were not observed.

This aluminum plate was coated with an intermediate layer and a photosensitive layer, followed by drying to prepare a positive type presensitized plate having a dry film thickness of 2.0 g/m$^2$. Printing using the presensitized plate gave a good printing plate.

EXAMPLE 8

An aluminum plate of JIS A 1050 having a thickness of 0.24 mm and a width of 1030 mm in which soaking and process annealing were omitted and streaks were liable to be developed by chemical etching in an acidic or alkaline aqueous solution was continuously treated.

(1) Mechanical Surface Roughening Treatment

The aluminum plate was mechanically roughened with rotational roller-like nylon brushes while feeding a suspension of aluminum hydroxide having a specific gravity of 1.12 and water as an abrasive slurry to a surface of the aluminum plate. As a material of the nylon brushes, nylon 610 was used. The length of bristles was 50 mm, and the diameter thereof was 0.48 mm. The nylon brush was produced by drilling holes in a stainless steel cylinder having a diameter of 300 mm and densely transplanting bristles thereto. Three rotational brushes were used. The distance of two support rolls (200 mm in diameter) under the brush was 300 mm. The brush roll was pressed until the load of a driving motor for rotating the brush reached +6 kw based on the load before the brush roll was pressed to the aluminum plate. The rotational direction of the brushes was the same as the travelling direction of the aluminum plate. Then, the aluminum plate was washed with water. The travelling speed of the aluminum plate was 50 m/minute.

(2) Electrolytic polishing Treatment in Alkaline Aqueous Solution

The aluminum plate was electropolished in an aqueous solution containing 3% or 9% by weight of sodium hydroxide, and 0%, 0.5%, 1% or 3% by weight of aluminum, using continuous direct current and using the aluminum plate as an anode at a current density of 10 A/dm$^2$, 30 A/dm$^2$ or 50 A/dm$^2$. The temperature of the alkaline aqueous solution was 35° C. The amount of the aluminum plate dissolved was 10 g/m$^2$. The average flow rate of the alkaline aqueous solution flowing between the aluminum plate and electrodes was 0 cm/second, 6 cm/second, 20 cm/second, 40 cm/second or 80 cm/second.

Then, the aluminum plate was washed with water by use of a spray.

(3) Chemical etching Treatment in Acidic Aqueous Solution

Then, the aluminum plate was immersed in an aqueous solution containing 25% by weight of sulfuric acid at 60° C. for 60 seconds to conduct chemical etching treatment, followed by washing with water.

The surface of the aluminum plate thus treated was visually observed. Consequently, results shown in Tables 1 to 3 were obtained. That is to say, when the average flow rate between the aluminum plate and the electrodes was 18 cm/second or more, no streaks or no treatment unevenness was developed even in cases where the aluminum concentration of the alkaline aqueous solution was established high.

TABLE 1

Invisibility of Streaks or Treatment Unevenness in Electrolytic polishing at NaOH Concentration of 3% by Weight (current density: 10 A/dm$^2$, solution temperature: 35° C.)

| Average Flow Rate (cm/second) | Aluminum Concentration 0 (wt %) | 0.5 (wt %) | 1 (wt %) |
|---|---|---|---|
| 0 | A | C | C |
| 6 | A | C | C |
| 18 | A | A | B |
| 40 | A | A | A |
| 80 | A | A | A |

A: Invisible, B: A little visible, C: Visible
Preferred levels are A and B.

TABLE 2

Invisibility of Streaks or Treatment Unevenness in Electrolytic polishing at NaOH Concentration of 9% by Weight (current density: 30 A/dm$^2$, solution temperature: 35° C.)

| Average Flow Rate (cm/second) | Aluminum Concentration 0 (wt %) | 0.5 (wt %) | 1 (wt %) | 3 (wt %) |
|---|---|---|---|---|
| 0 | A | A | A | C |
| 6 | A | A | A | C |
| 18 | A | A | A | A |
| 40 | A | A | A | A |
| 80 | A | A | A | A |

A: Invisible, B: A little visible, C: Visible
Preferred levels are A and B.

TABLE 3

Invisibility of Streaks or Treatment Unevenness in Electrolytic polishing at NaOH Concentration of 15% by Weight and Aluminum Concentration of 5% by Weight (average flow rate: 18 cm/second)

| Current Density (A/dm$^2$) | Solution Temperature 25° C. | 35° C. | 45° C. | 55° C. |
|---|---|---|---|---|
| 20 | B | A | A | B |
| 50 | — | A | A | B |

A: Invisible, B: A little visible, C: Visible
Preferred levels are A and B.

EXAMPLE 9

Using an aluminum plate of JIS A 1050 having a thickness of 0.24 mm and a width of 1030 mm in which soaking and process annealing were omitted and streaks were liable to be developed by chemical etching in an acidic or alkaline aqueous solution, the following treatment was continuously performed.

(1) Mechanical Surface Roughening Treatment

The aluminum plate was mechanically roughened with rotational roller-like nylon brushes while feeding a suspension of aluminum hydroxide having a specific gravity of 1.12 and water as an abrasive slurry to a surface of the aluminum plate. As a material of the nylon brushes, nylon 610 was used. The length of bristles was 50 mm, and the diameter thereof was 0.48 mm. The nylon brush was produced by drilling holes in a stainless steel cylinder having a diameter of 300 mm and densely transplanting bristles thereto. Three rotational brushes were used. The distance of two support rolls (200 mm in diameter) under the brush was 300 mm. The brush roll was pressed until the load of a driving motor for rotating the brush reached +6 kw based on the load before the brush roll was pressed to the aluminum plate. The rotational direction of the brushes was the same as the travelling direction of the aluminum plate. Then, the aluminum plate was washed with water. The travelling speed of the aluminum plate was 50 m/minute.

(2) Electrolytic polishing Treatment in Alkaline Aqueous Solution

The aluminum plate was electropolished in an aqueous solution containing 9% by weight of sodium hydroxide and 3% by weight of aluminum at 45° C., using the aluminum plate as an anode at a current density of 40 A/dm$^2$ and at an average flow rate between the aluminum plate and electrodes of 50 cm/second. The amount of the aluminum late dissolved was 3 g/m$^2$.

Then, the aluminum plate was washed with water by use of a spray.

(3) Chemical Etching Treatment in Alkaline Aqueous Solution

Then, the aluminum plate was immersed in an aqueous solution containing 26% by weight of sodium hydroxide and 6% by weight of aluminum at 70° C. to conduct chemical etching treatment dissolving 1 g/m$^2$ of the aluminum plate.

Then, the aluminum plate was washed with water.

(4) Electrochemical Surface Roughening Treatment

Electrochemical surface roughening treatment was continuously conducted using alternating voltage. The device shown in FIG. 6 was used. An electrolyte used at this time was a 1 wt% aqueous solution of nitric acid (containing 0.5% by weight of aluminum ions and 0.007% by weight of ammonium ions), and the solution temperature was 45° C. In a alternating voltage waveform, the time tp required until the current value reached a peak form 0 was 1 millisecond, and the duty ratio was 1:1. Using trapezoidal rectangular wave alternating current, and using a carbon electrode as a counter electrode, the electrochemical surface roughening treatment was conducted. As an auxiliary anode, ferrite was used.

The current density was 60 A/dm$^2$ in the peak value of current, and the total quantity of electricity was 250 C/dm$^2$ when the aluminum plate was an anode. To the auxiliary anode, 5% of the current flowing from the power supply was shunted.

Then, the aluminum plate was washed with water by use of a spray.

(5) Electrolytic polishing Treatment in Alkaline Aqueous Solution

The aluminum plate was electropolished in an aqueous solution containing 9% by weight of sodium hydroxide and 3% by weight of aluminum at 45° C., using the aluminum plate as an anode at a current density of 40 A/dm$^2$ and at an average flow rate between the aluminum plate and electrodes of 50 cm/second. The amount of the aluminum plate dissolved was 1 g/m$^2$.

Then, the aluminum plate was washed with water by use of a spray.

(6) chemical Etching Treatment in Alkaline Aqueous Solution

The aluminum plate was immersed in an aqueous solution containing 9% by weight of sodium hydroxide and 3% by weight of aluminum at 70° C. to conduct chemical etching treatment dissolving 0.2 g/m$^2$ of the aluminum plate.

Then, the aluminum plate was washed with water.

(7) Anodizing Treatment

Anodizing treatment was conducted with a 15 wt% aqueous solution of sulfuric acid (this solution contained 0.5% by weight of aluminum ions) at a solution temperature of 35° C., using direct current voltage, so as to give an amount of anodic oxide films of 2.4 g/m$^2$ a current density of 2 A/dm$^2$. then, the aluminum plate was washed with water by use of a spray.

The surface of the aluminum plate thus treated was visually observed. As a result, streaks caused by the orientation of crystal grains were not observed.

The surface of this aluminum plate was observed under a scanning electron microscope. Consequently, it was observed that honeycomb pits having an average diameter of 0.5 $\mu$m to 2 $\mu$m were formed uniformly and densely. This aluminum plate had an average surface roughness of 0.5 $\mu$m.

This aluminum plate was coated with an intermediate layer and photosensitive layer, followed by drying to prepare a positive type presensitized plate having a dry film thickness of 2.0 g/m$^2$. printing using this presensitized plate gave a good printing plate.

EXAMPLE 10

The substrate after the anodizing treatment obtained in Example 9 was immersed in a 2.5 wt% aqueous solution of sodium silicate at 70° C. for 14 seconds, for conducting hydrophilizing treatment, followed by washing with water by use of a spray and drying. After each treatment and washing, the solution was removed with nip rolls.

This treated aluminum plate was coated with an intermediate layer and a negative type photosensitive layer, followed by drying to prepare a presensitized plate. Printing of this presensitized plate gave a good printing plate.

On the surface of this aluminum plate, streaks caused by the orientation of crystal grains were not developed.

EXAMPLE 11

As the slurry used in the mechanical polishing treatment of Example 9, (1), a liquid mainly containing silica sand was used. The specific gravity was 1.12. The treatment was conducted in the same manner as with Example 9 with the exception that the amount of aluminum dissolved in Example 9, (2) was changed to 8 g/m$^2$. On the surface of this aluminum plate, streaks caused by the orientation of crystal grains were not developed.

This aluminum plate was coated with an intermediate layer and a photosensitive layer, followed by drying to prepare a positive type presensitized plate having a dry film thickness of 2.0 g/m$^2$. Printing using this presensitized plate gave a good printing plate.

EXAMPLE 12

The aluminum plate was surface roughened in the same manner as with Example 9 with the exception that the steps of Example 9, (1) and (2) were changed as follows.

That is to say, the diameter of bristles of the nylon brush used in Example 9, (1) was changed to 1.07 mm, and the amount of the aluminum plate dissolved in Example 9, (2) was changed to 7 g/m$^2$.

The surface of the aluminum plate thus treated was visually observed. As a result, streaks caused by the orientation of crystal grains were not observed.

The surface of this aluminum plate was observed under a scanning electron microscope. Consequently, it was observed that honeycomb pits having an average diameter of 0.5 $\mu$m to 2 $\mu$m were formed uniformly and densely. This aluminum plate had an average surface roughness of 0.7 $\mu$m.

This aluminum plate was coated with an intermediate layer and a photosensitive layer, followed by drying to prepare a positive type presensitized plate having a dry film thickness of 2.0 g/m$^2$. Printing using this presensitized plate gave a good printing plate.

EXAMPLE 13

An aluminum plate of JIS A 1050 having a thickness of 0.24 mm and a width of 1030 mm in which soaking and process annealing were omitted and streaks were liable to be developed by chemical etching in an acidic or alkaline aqueous solution was continuously treated.

(1) Mechanical Surface Roughening Treatment

The aluminum plate was mechanically roughened with rotational roller-like nylon brushes while feeding a suspension of silica sand having a specific gravity of 1.12 and water as an abrasive slurry to a surface of the aluminum plate. As a material of the nylon brushes, nylon 610 was used. The length of bristles was 50 mm, and the diameter thereof was 0.48 mm. The nylon brush was produced by drilling holes in a stainless steel cylinder having a diameter of 300 mm and densely transplanting bristles thereto. Three rotational brushes were used. The distance of two support rolls (200 mm in diameter) under the brush was 300 mm. The brush roll was pressed until the load of a driving motor for rotating the brush reached +6 kw based on the load before the brush roll was pressed to the aluminum plate. The rotational direction of the brushes was the same as the travelling direction of the aluminum plate. Then, the aluminum plate was washed with water. The travelling speed of the aluminum plate was 50 m/minute.

(2) Electrolytic polishing Treatment in Alkaline Aqueous Solution

The aluminum plate was electropolished in an aqueous solution containing 9% by weight of sodium hydroxide and 1% by weight of aluminum at 45° C., using the aluminum plate as an anode at a current density of 40 A/dm$^2$ and at an average flow rate between the aluminum plate and electrodes of 100 cm/second. The amount of the aluminum plate dissolved was 6 g/m$^2$. Then, the aluminum plate was washed with water by use of a spray. At this time, the voltage between the aluminum plate and the cathodes opposite thereto was 10 V.

(3) Chemical Etching Treatment in Alkaline Aqueous Solution

Then, chemical etching treatment dissolving 0.3 g/m$^2$ of the aluminum plate was conducted with an aqueous solution containing 9% by weight of sodium hydroxide and 1% by weight of aluminum at 45° C. Then, the aluminum plate was washed with water.

(4) Desmutting Treatment

The aluminum plate was immersed in an aqueous solution containing 10% by weight of sulfuric acid (containing 0.5% by weight of aluminum ions) at 35° C. for 2 seconds to conduct desmutting treatment.

(5) Anodizing Treatment

Anodizing treatment was conducted with a 10 wt% aqueous solution of sulfuric acid (containing 0.5% by weight of aluminum ions) at a solution temperature of 35° C., using direct current voltage, so as to give an amount of anodic oxide films of 2.4 g/m$^2$ at a current density of 2 A/dm$^2$. Then, the aluminum plate was washed with water by use of a spray.

The surface of the aluminum plate thus treated was visually observed. As a result, streaks caused by the orientation of crystal grains were not observed.

This aluminum plate was coated with an intermediate layer and a photosensitive layer, followed by drying to prepare a positive type presensitized plate having a dry film thickness of 2.0 g/m$^2$. Printing using this presensitized plate gave a good printing plate.

EXAMPLE 14

The substrate after the anodizing treatment obtained in Example 13 was immersed in a 2.5 wt% aqueous solution of sodium silicate at 70° C. for 14 seconds, for conducting hydrophilizing treatment, followed by washing with water by use of a spray and drying. After each treatment and washing, the solution was removed with nip rolls.

This treated aluminum plate was coated with an intermediate layer and a negative type photosensitive layer, followed by drying to prepare a presensitized plate. Printing of this presensitized plate gave a good printing plate.

On the surface of this aluminum plate, streaks caused by the orientation of crystal grains were not developed.

EXAMPLE 15

An aluminum plate of JIS A 1050 having a thickness of 0.24 mm and a width of 1030 mm in which soaking and process annealing wear omitted and streaks were liable to be developed by chemical etching in an acidic or alkaline aqueous solution was continuously treated.

(1) Mechanical Surface Roughening Treatment

The aluminum plate was mechanically roughened with rotational roller-like nylon brushes while feeding a suspension of silica sand having a specific gravity of 1.12 and water as an abrasive slurry to a surface of the aluminum plate. As a material of the nylon brushes, nylon 610 was used. The length of bristles was 50 mm, and the diameter thereof was 0.48 mm. They nylon brush was produced by drilling holes in a stainless steel cylinder having a diameter of 300 mm and densely transplanting bristles thereto. Three rotational brushes were used. The distance of two support rolls (200 mm in diameter) under the brush was 300 mm. The brush roll was pressed until the load of a driving motor for rotating the brush reached +6 kw based on the load before the brush roll was pressed to the aluminum plate. The rotational direction of the brushes was the same as the travelling direction of the aluminum plate. Then, the aluminum plate was washed with water. The travelling speed of the aluminum plate was 50 m/minute.

(2) Electrolytic polishing Treatment in Alkaline Aqueous Solution

The aluminum plate was electropolished in an aqueous solution containing 9% by weight of sodium hydroxide and 1% by weight of aluminum at 45° C., using the aluminum plate as an anode at a current density of 40 A/dm$^2$ and at an average flow rate between the aluminum plate and electrodes of 100 cm/second. The amount of the aluminum plate dissolved was 10 g/m$^2$.Then, the aluminum plate was washed with water by use of a spray. At this time, the voltage between the aluminum plate and the cathodes opposite thereto was 10 V.

(3) Chemical Etching Treatment in Alkaline Aqueous Solution

Then, chemical etching treatment dissolving 0.3 g/m$^2$ of the aluminum plate was conducted with an aqueous solution containing 9% by weight of sodium hydroxide and 1% by weight of aluminum at 45° C. Then, the aluminum plate was washed with water.

(4) Desmutting Treatment

The aluminum plate was immersed in an aqueous solution containing 10% by weight of sulfuric acid (containing 0.5% by weight of aluminum ions) at 35° C. for 2 seconds to conduct desmutting treatment.

(5) Electrochemical Surface Roughening Treatment

Electrochemical surface roughening treatment was continuously conducted using alternating voltage. The device shown in FIG. 6 was used. An electrolyte used at this time was a 1 wt% aqueous solution of nitric acid (containing 0.5% by weight of aluminum ions and 0.007% by weight of ammonium ions), and the solution temperature was 65° C. In a alternating voltage waveform, the time tp required until the current valve reached a peak from 0 was 1 millisecond, and the duty ration was 1:1. Using trapezoidal rectangular wave alternating current, and using a carbon electrode as a counter electrode, the electrochemical surface roughening treatment was conducted. As an auxiliary anode, ferrites was used.

The current density was 60 A/dm$^2$ in the peak value of current, and the total quantity of electricity was 150 C/dm$^2$ when the aluminum plate was an anode. To the auxiliary anode, 5% of the current flowing form the power supply was shunted.

Then, the aluminum plate was washed with water by use of a spray.

(6) Chemical Etching Treatment in Acidic Aqueous Solution

Then, the aluminum plate was immersed in an aqueous solution containing 25% by weight of sulfuric acid at 60° C. for 30 seconds to conduct chemical etching treatment, followed by washing with water.

(7) Anodizing Treatment

Anodizing treatment was conducted with a 10 wt% aqueous solution of sulfuric acid (containing 0.5% by weight of aluminum ions) at a solution temperature of 35° C., using direct current voltage, so as to give an amount of anodic oxide films of 2.4 g/m$^2$ at a current density of 2 A/dm$^2$. Then the aluminum plate was washed with water by use of a spray.

The surface of the aluminum plate thus treated was visually observed. As a result, streaks caused by the orientation of crystal grains were not observed.

This aluminum plate was coated with a intermediate layer and a photosensitive layer, followed by drying to prepare a positive type presensitized plate having a dry film thickness of 2.0 g/m$^2$. Printing using this presensitized plate gave a good printing plate.

EXAMPLE 16

The substrate after the anodizing treatment obtained in Example 15 was immersed in a 2.5 wt% aqueous solution of sodium silicate at 70° C. for 14 seconds, for conducting hydrophilizing treatment, followed by washing with water by using of a spray and drying. After each treatment and washing, the solution was removed with nip rolls.

This treated aluminum plate was coated with an intermediate layer and a negative type photosensitive layer, followed by drying to prepare a presensitized plate. Printing of this presensitized plate gave a good printing plate.

On the surface of this aluminum plate, streaks caused by the orientation of crystal grains were not developed.

As descried above, according to the methods for producing the aluminum supports for lithographic printing plates of the present invention, even inexpensive aluminum plates can be used as the aluminum supports for lithographic printing plates, because the electrolytic polishing treatment of the aluminum plates in the alkaline solutions using the aluminum plates as the anodes brings about no treatment uneveness caused by the difference in orientation of crystal grains.

Further, the amount of aluminum dissolved can be controlled by the quantity of electricity turned on, so that it can be easily controlled by a production control system using a computer. Accordingly, the productivity can be heightened while keeping high quality.

Furthermore, no use of relatively high temperature and high concentration aqueous solutions makes it possible to avoid a deterioration in corrosion resistance.

In addition, the concentration and temperature of the alkaline solutions used in the electrolytic polishing treatment can be established lower than those of chemical etching solutions, resulting in easy adjustment and control. It is therefore very easy to stabilize the quality.

Further, in the production of the aluminum supports for lithographic printing plates, the concretion of aluminum in the alkaline aqueous solutions can be established high, and the amount of waste liquid can be decreased by allowing the alkaline aqueous solutions to flow through spaces between the aluminum plates and the electrodes at the specified flow rate. Further, the recovery and recycling of alkalis by crystallization and the discharge of eluted aluminum to outside of a system become easy by establishing the aluminum concentration high.

Furthermore, the amount of aluminum dissolved can be controlled by the quantity of electricity turned on, so that it can be easily controlled by a production control system using a computer. Accordingly, the productivity can be heightened while keeping high quality.

In addition, the concentration and temperature of the alkaline solutions used in the electrolytic polishing treatment can be established lower than those of chemical etching solutions, resulting in easy adjustment and control. It is therefore very easy to stabilize the quality.

While the invention has been described in detail and with reference to specific embedments thereof, it will be apparent to one skilled in the art that various changes and modifications can be made therein without departing from the spirit and scope thereof.

What is claimed is:

1. A method for producing an aluminum support for a lithographic printing plate comprising the steps of:

(a) electrolytic polishing an aluminum plate in an alkaline aqueous solution; and (b) electrochemically surface roughening the aluminum plate using direct or alternating current in an acidic aqueous solution in this order.

2. The method according to claim 1 wherein the aluminum plate is chemically etched in an alkaline or acidic aqueous solution, or electrolytically etched using the aluminum plate as a cathode in an alkaline or acidic aqueous solution, before and/or after the electrolytic polishing treatment in the alkaline aqueous solution.

3. The method according to claim 1, wherein the aluminum plate is desmutted after the electrolytic polishing treatment in the alkaline aqueous solution or a chemical etching treatment in an alkaline aqueous solution or an electrolytic etching treatment using the aluminum plate as the cathode in an alkaline aqueous solution.

4. The method according to claim 1, wherein the alkaline aqueous solution used in the electrolytic polishing treatment is an aqueous solution mainly containing sodium hydroxide.

5. A method for producing an aluminum support for a lithographic printing plate comprising mechanically surface roughening an aluminum plate, and then, conducting the treatment according to claim 1.

6. The method according to claim 1, wherein the aluminum plate is further subsequently anodized.

7. The method according to claim 6, wherein the anodized aluminum plate is then hydrophilized.

8. The method according to claim 1, wherein ferrite, platinum or iridium oxide is used as an anode material.

9. The method according to claim 1, wherein carbon, silver, nickel, pure iron, stainless steel, titanium, tantalum, niobium, zirconium, hafnium or platinum is used as a cathode material.

10. A method for producing an aluminum support for a lithographic printing plate comprising the steps of:

(a) electrochemically surface roughening an aluminum plate using direct or alternating current in an acidic aqueous solution; and (b) electrolytic polishing the aluminum plate in an alkaline aqueous solution in this order.

11. The method according to claim 10 wherein the aluminum plate is chemically etched in an alkaline or acidic aqueous solution, or electrolytically etched using the aluminum plate as a cathode in an alkaline or acidic aqueous solution, before an/or after the electrolytic polishing treatment in the alkaline aqueous solution.

12. The method according to claim 10, wherein the aluminum plate is desmutted after the electrolytic polishing treatment in the alkaline aqueous solution or a chemical etching treatment in an alkaline aqueous solution or an electrolytic etching treatment using the aluminum plate as the cathode in an alkaline aqueous solution.

13. The method according to claim 10, wherein the alkaline aqueous solution used in the electrolytic polishing treatment is an aqueous solution mainly containing sodium hydroxide.

14. A method for producing an aluminum support for a lithographic printing plate comprising mechanically surface roughening an aluminum plate, and then, conducting the treatment according to claim 10.

15. The method according to claim 10, wherein the aluminum plate is further subsequently anodized.

16. The method according to claim 10, wherein ferrite, platinum or iridium oxide is used as an anode material.

17. The method according to claim 10, wherein carbon, silver, nickel, pure iron, stainless steel, titanium, tantalum, niobium, zirconium, hafnium or platinum is used as a cathode material.

18. A method for producing an aluminum support for a lithographic printing plate comprising the steps of:

(a) electrolytic polishing an aluminum plate in an alkaline aqueous solution;

(b) electrochemically surface roughening the aluminum plate using direct or alternating current in an acidic aqueous solution; and (c) electrolytic polishing an aluminum plate in an alkaline aqueous solution in this order.

19. A method for producing an aluminum support for a lithographic printing plate comprising the steps of:

(a) chemically etching an aluminum plate in an acidic or alkaline aqueous solution;

(b) electrochemically surface roughening the aluminum plate using direct or alternating current in an acidic aqueous solution; and (c) electrolytic polishing the aluminum plate in an alkaline aqueous solution in this order.

20. A method for producing an aluminum support for a lithographic printing plate comprising the steps of:

(a) electrolytic polishing an aluminum plate in an alkaline aqueous solution;

(b) electrochemically surface roughening the aluminum plate using direct or alternating current in an acidic aqueous solution; and (c) chemically etching an aluminum plate in an acidic or alkaline aqueous solution in this order.

21. A method for producing an aluminum support for a lithographic printing plate comprising an electrolytic polishing step of treating an aluminum plate used as a anode in an alkaline aqueous solution at a current density of 5 $A/dm^2$ to 200 $A/d^2$ while allowing the alkaline aqueous solution to flow between the aluminum plate and an electrode at an average flow rate of 10 cm/second to 400 cm/second.

22. The method according to claim 21, wherein the alkaline aqueous solution is an aqueous solution having an alkaline substance concentration of 2% to 30% by weight and an aluminum concentration of 0.5% to 10% by weight.

23. The method according to claim 22, wherein the alkaline aqueous solutions is an alkaline aqueous solution having a temperature of 20° C. to 80° C.

24. The method according to claim 21, wherein the alkaline aqueous solution is an alkaline aqueous solution having a temperature of 20° C. to 80° C.

* * * * *